US009137867B2

(12) United States Patent
Kamii et al.

(10) Patent No.: US 9,137,867 B2
(45) Date of Patent: Sep. 15, 2015

(54) LIGHTING DEVICE

(75) Inventors: Miwa Kamii, Osaka (JP); Masako Nishihashi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 470 days.

(21) Appl. No.: 13/643,313

(22) PCT Filed: Apr. 11, 2011

(86) PCT No.: PCT/JP2011/058978
§ 371 (c)(1),
(2), (4) Date: Oct. 25, 2012

(87) PCT Pub. No.: WO2011/136007
PCT Pub. Date: Nov. 3, 2011

(65) Prior Publication Data

US 2013/0038244 A1 Feb. 14, 2013

(30) Foreign Application Priority Data

Apr. 26, 2010 (JP) ..... 2010-100878

(51) Int. Cl.
*H05B 41/36* (2006.01)
*H05B 33/08* (2006.01)

(52) U.S. Cl.
CPC ..... *H05B 33/0818* (2013.01); *H05B 33/086* (2013.01)

(58) Field of Classification Search
USPC ..... 315/185 R, 192, 291, 294, 297, 307, 315/308, 312, 360
See application file for complete search history.

(56) References Cited

U.S. PATENT DOCUMENTS

| | | | | |
|---|---|---|---|---|
| 5,357,170 | A * | 10/1994 | Luchaco et al. | 315/159 |
| 6,188,182 | B1 | 2/2001 | Nickols et al. | |
| 8,033,686 | B2 * | 10/2011 | Recker et al. | 362/249.02 |
| 2005/0035728 | A1 * | 2/2005 | Schanberger et al. | 315/291 |
| 2009/0026973 | A1 | 1/2009 | Kato et al. | |
| 2015/0002028 | A1 * | 1/2015 | Chen | 315/153 |

FOREIGN PATENT DOCUMENTS

| | | | |
|---|---|---|---|
| CN | 1242136 | A | 1/2000 |
| CN | 101310140 | A | 11/2008 |
| JP | 2000-252084 | A | 9/2000 |
| JP | 2000-294384 | A | 10/2000 |
| JP | 2006-252944 | A | 9/2006 |
| JP | 2007-103353 | A | 4/2007 |
| JP | 2007-287671 | A | 11/2007 |

OTHER PUBLICATIONS

International Search Report, dated Jun. 28, 2011, Issued in PCT/JP2011/058978.

* cited by examiner

*Primary Examiner* — Douglas W Owens
*Assistant Examiner* — Jianzi Chen
(74) *Attorney, Agent, or Firm* — Birch, Stewart, Kolasch & Birch, LLP

(57) ABSTRACT

The disclosed lighting device gradually adjusts from an incandescent bulb color having a 30% dimming rate to a daylight color having a 100% dimming rate. The overall dimming rate is changed to a linear shape, and the ratio of the dimming rates of the incandescent bulb color and the daylight color is adjusted. When changing from the incandescent bulb color to the daylight color, the color is changed to an intermediate color that mixes the incandescent bulb color and the daylight color, and then ultimately is changed to the daylight color, and so it is possible to change the dimming rate without causing discomfort or annoyance in humans, and a comfortable and natural light environment is achieved.

7 Claims, 26 Drawing Sheets

FIG.8

| OPERATION NAME | TIME DEFINITION | TIME OF DAY | CONTENTS※ |
|---|---|---|---|
| Early morning operation (time period tA) | An hour before wake-up time | 5:30-6:30 | Brightness: dimming rate is changed from night-time dimming rate of 30% to 100%.<br>Color tone: changed from incandescent lamp color to daylight color. |
| Day time operation (time period tB) | From wake up time until one hour before dinner time | 6:30-18:00 | Brightness: dimming rate 100% (unchanged)<br>Color tone: daylight color (unchanged) |
| Sunset time operation (time period tC) | One hour before dinner time | 18:00-19:00 | Brightness: dimming rate 100% (unchanged)<br>Color tone: changed from the daylight color to the incandescent lamp color |
| Dinner time operation (time period tD) | From dinner time until two hours before bed time | 19:00-21:00 | Brightness: dimming rate 100% (unchanged)<br>Color tone: incandescent lamp color (unchanged) |
| Bed time operation (time period tE) | Two hours before bed time | 21:00-23:00 | Brightness: dimming rate is changed to night time dimming rate of 30%<br>Color tone: incandescent lamp color (unchanged) |
| Night time operation (time period tF) | From bed time to one hour before wake-up time | 23:00-5:30 | Brightness: night time dimming rate of 30% (unchanged)<br>Color tone: incandescent lamp color (unchanged) |

FIG.12
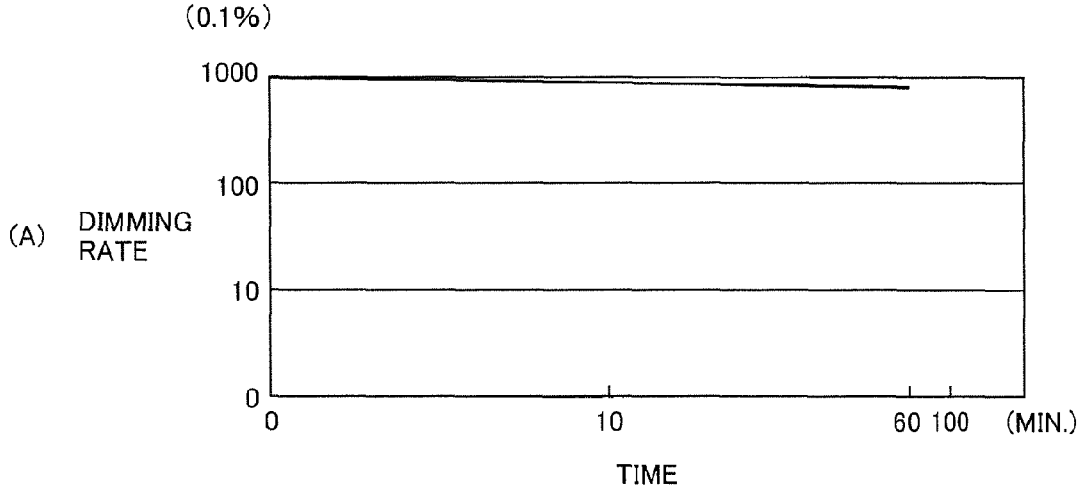
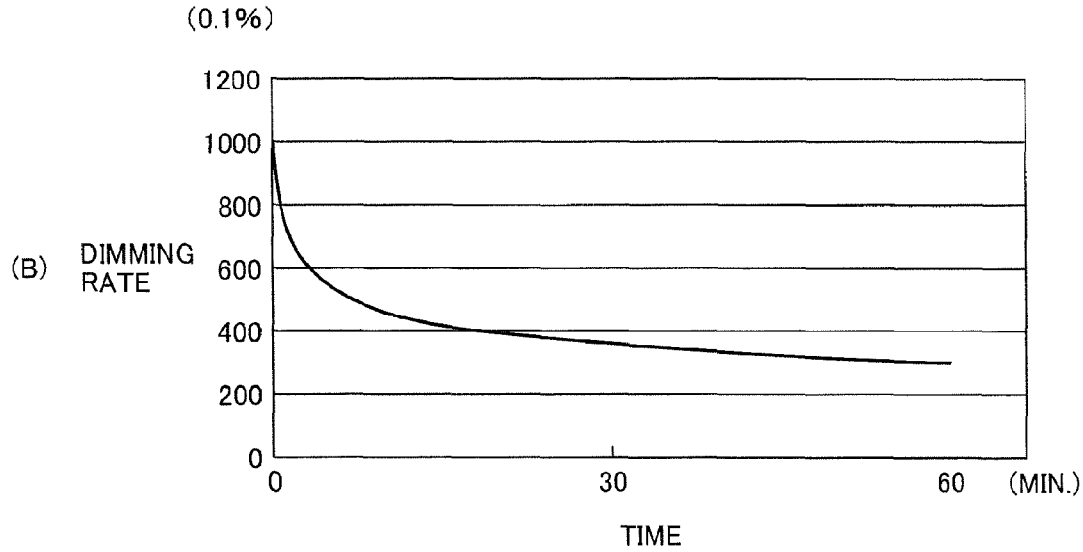

FIG.16

| Set item | Setting range |
|---|---|
| Wake up time | Any time between 0:00 – 23:59 ※<br>Setting of time within 1:59 from bed time unacceptable |
| Dinner time | Any time between 0:00 – 23:59 ※<br>Setting of time within 59 minutes from wake up time unacceptable |
| Bed time | Any time between 0:00 – 23:59 ※ |

FIG.17

(A)

CUSTOM SETTING

PLEASE SET WAKE-UP TIME

7 : 00

IF THE SETTING IS OK,
PLEASE PRESS "CUSTOM"
SETTING BUTTON (B)

CUSTOM SETTING

PLEASE SET DINNER TIME

19 : 30

IF THE SETTING IS OK,
PLEASE PRESS "CUSTOM"
SETTING BUTTON (C)

CUSTOM SETTING

PLEASE SET BED TIME

23 : 30

IF THE SETTING IS OK,
PLEASE PRESS "CUSTOM"
SETTING BUTTON (D)

CUSTOM SETTING

PLEASE SET NIGHT TIME
DIMMING RATE

30%

IF THE SETTING IS OK,
PLEASE PRESS "CUSTOM"
SETTING BUTTON

FIG.19
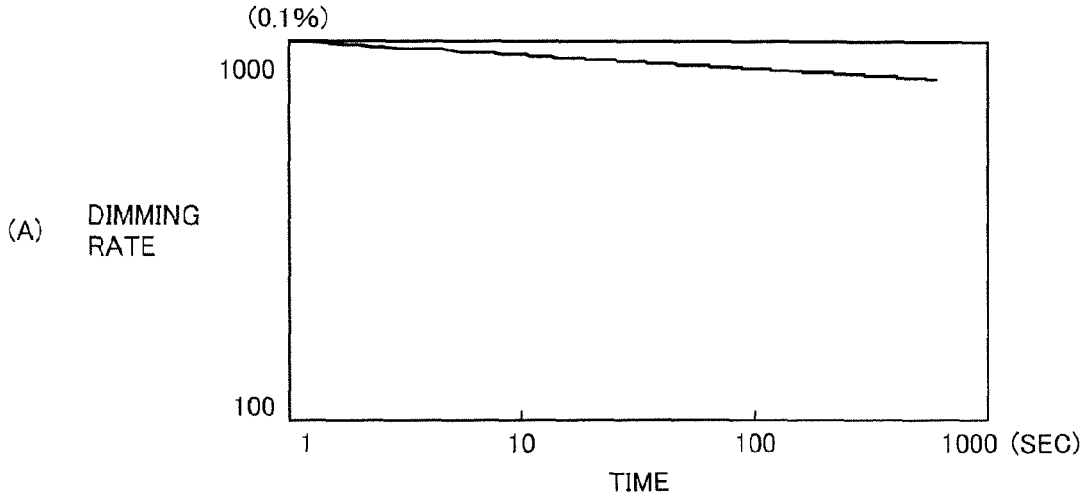
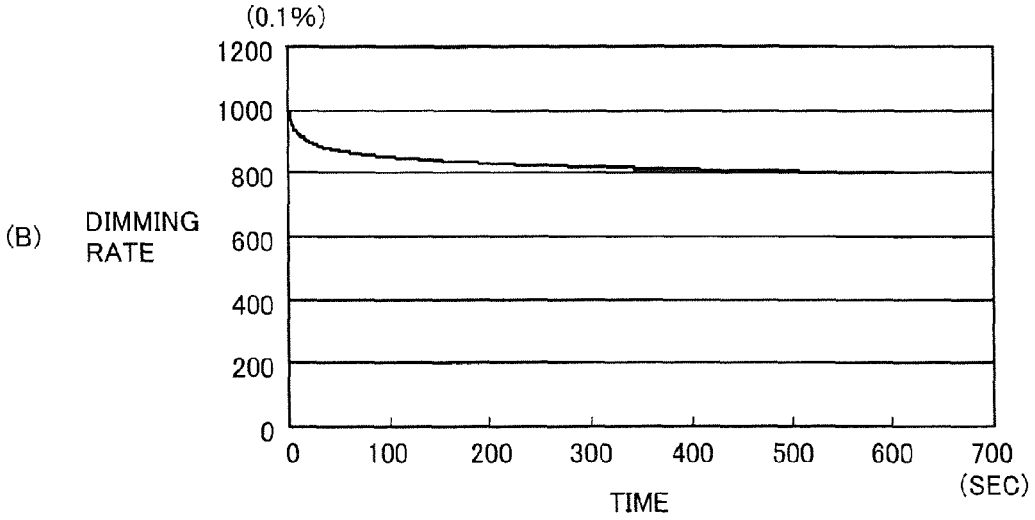

FIG.27

| | DIMMING RATE (X) | ARITHMETIC EXPRESSIONS | |
|---|---|---|---|
| | | APPROXIMATION FORMULAS CALCULATED FROM LED OUTPUT CHARACTERISTIC LINE | |
| DAYLIGHT COLOR LED | 0 ~ 600 | $(1/2^{11})X^2+(1-1/2^2-1/2^5)X$ | —(11) |
| | | $0.0005X^2 + 0.7074X$ | |
| | 601 ~ 910 | $(1/2^9-1/2^{12})X^2-(1/2+1/2^3+1/2^5+1/2^9)X+384$ | —(12) |
| | | $0.0017X^2-0.6582X+393.87$ | |
| | 911 ~ 980 | $(3+1/2^3+1/2^4+1/2^6+1/2^7-1/2^{11})X-1713$ | —(13) |
| | | $3.2104X-1713.5$ | |
| | 981 ~ 1000 | $14X-12331$ | —(14) |
| | | APPROXIMATION FORMULA NOT USED | |
| INCANDESCENT LAMP COLOR LED | 0 ~ 825 | $(1/2^{12}-1/2^{15})X^2+(1-1/2+1/2^3)X$ | |
| | | $0.0002X^2 + 0.6348X$ | |
| | 826 ~ 970 | $(1/2^7-1/2^{10}-1/2^{11}+1/2^{14})X^2-(9+1/2+1/2^5)X+4164$ | |
| | | $0.0064X^2-9.5415X+4164.3$ | |
| | 971 ~ 999 | $(1/2^4-1/2^7+1/2^{10})X^2-(105+1/2^2-1/2^5)X+50642$ | |
| | | $0.0558X^2-105.21X+50509$ | |
| | 1000 | 1670 | |
| | | APPROXIMATION FORMULA NOT USED | |

LIGHTING DEVICE

TECHNICAL FIELD

The present invention relates to a lighting device and, more specifically, to a lighting device using a light emitting diode (LED) as a light source.

BACKGROUND ART

Conventional lighting devices generally use incandescent lamps or fluorescent lamps, and operations of such devices include light-on, light-off, brightness adjustment by adjusting output, and lighting of a night-light (tiny lamp).

Recently, because of remarkable developments of light emitting diodes (LEDs), LEDs of high brightness and high output with various output wavelengths come to be practically used. A lighting device using such LEDs allows, in addition to the light-on and light-off operations, the user to flexibly change color tone of illumination, as LEDs having different wavelengths are combined and respective outputs can be adjusted. It is difficult, however, to adjust the LED outputs to attain favorable color tone, for a person not having any knowledge of optical or illumination field. Therefore, some scheme that facilitates light adjustment is desirable.

Light environment has significant psychological and biological influences on humans. Therefore, appropriate design of light environment is one of basic elements to attain healthy and comfortable living environment.

In this regard, a light environment that combines illumination and the phase of autonomous, intrinsic rhythm (biological rhythm) of a human is desirable, for one to enjoy healthy and comfortable life.

Japanese Patent Laying-Open No. 2000-294384 proposes a method of switching two fluorescent lamps having different color temperatures in accordance with time zone.

CITATION LIST

Patent Literature

PTL 1: Japanese Patent Laying-Open No. 2000-294384

SUMMARY OF INVENTION

Technical Problem

In designing the light environment, if switching of illumination is inappropriate, it will evoke a feeling of strangeness or discomfort, and a good life environment cannot be realized. Further, since individuality differs person to person, light environment most convenient for each individual should be considered.

The present invention was made to solve such a problem, and its object is to provide a lighting device that can realize comfortable light environment.

Solution to Problem

According to an aspect, the present invention provides a lighting device, including: a plurality of light emitting units having different color temperatures; a control circuit for executing emission output control of each of the plurality of light emitting units; time keeping unit for keeping time; and a memory storing control information used for emission output control of the plurality of light emitting units to realize a desired light environment at a prescribed time of day. The control circuit executes emission output control of the plurality of light emitting units, with reference to the memory and based on the control information, gradually from before the prescribed time of day so that the desired light environment is realized at the prescribed time of day.

Preferably, the control information stored in the memory corresponds to dimming rates of the plurality of light emitting units corresponding to prescribed time of day for adjusting human life rhythm.

Particularly, the plurality of light emitting units includes first and second light emitting units having different color temperatures; based on the control information, the control circuit is configured to set: in a first time period of a day, a first dimming rate by lighting the first light emitting unit; in a second time period of the day following the first time period, switch lighting of the first light emitting unit to lighting of the second light emitting unit, and set the dimming rate to be changed from the first dimming rate to the second dimming rate; in a third time period of the day following the second time period, set a second dimming rate by lighting the second light emitting unit, in a fourth time period of the day following the third time period; switch lighting of the second light emitting unit to lighting of the first light emitting unit, and maintain the second dimming rate; in a fifth time period of the day following the fourth time period, set the second dimming rate by lighting the first light emitting unit; and in a sixth time period of the day following the fifth time period, set the dimming rate to be changed from the second dimming rate to the first dimming rate, by lighting the first light emitting unit.

Preferably, the lighting device further includes a setting receiving unit for setting the control information.

Preferably, the control circuit gradually increases dimming rate of at least one of the plurality of light emitting units from before the prescribed time of day.

Preferably, the control unit gradually reduces dimming rate of at least one of the plurality of light emitting units and gradually increases dimming rate of another light emitting unit, different from the at least one, of the plurality of light emitting units, as time passes.

Particularly, the control circuit adjusts the dimming rates of one and another light emitting units to be changed in accordance with a linear function.

Advantageous Effects of Invention

By the configuration described above, in order to realize desired light environment at a prescribed time of day, based on the control information, the control circuit of the lighting device controls emission output of a plurality of light emitting units gradually before the prescribed time of day to cause variation in a natural manner, so that comfortable light environment not invoking any feeling of strangeness or discomfort can be realized.

BRIEF DESCRIPTION OF DRAWINGS

FIG. 8 is a table of operations representing operations of an illuminating unit 30 in each time period of light environment control mode.

FIG. 12 is another graph of dimming rate of incandescent lamp color in the time period tE, in accordance with the embodiment of the present invention.

FIG. 16 specifies time settings of wake-up time, dinner time and bed time by custom setting, in accordance with the embodiment of the present invention.

FIG. 17 illustrates screen images for custom setting on a liquid crystal panel 52 of remote controller 50 in accordance with the embodiment of the present invention.

FIG. 19 is a graph of dimming rate in an eco-light mode in accordance with the embodiment of the present invention.

FIG. 27 specifies approximation formulas of output characteristic lines of LED modules 31 and 32.

DESCRIPTION OF EMBODIMENTS

Figure 1:
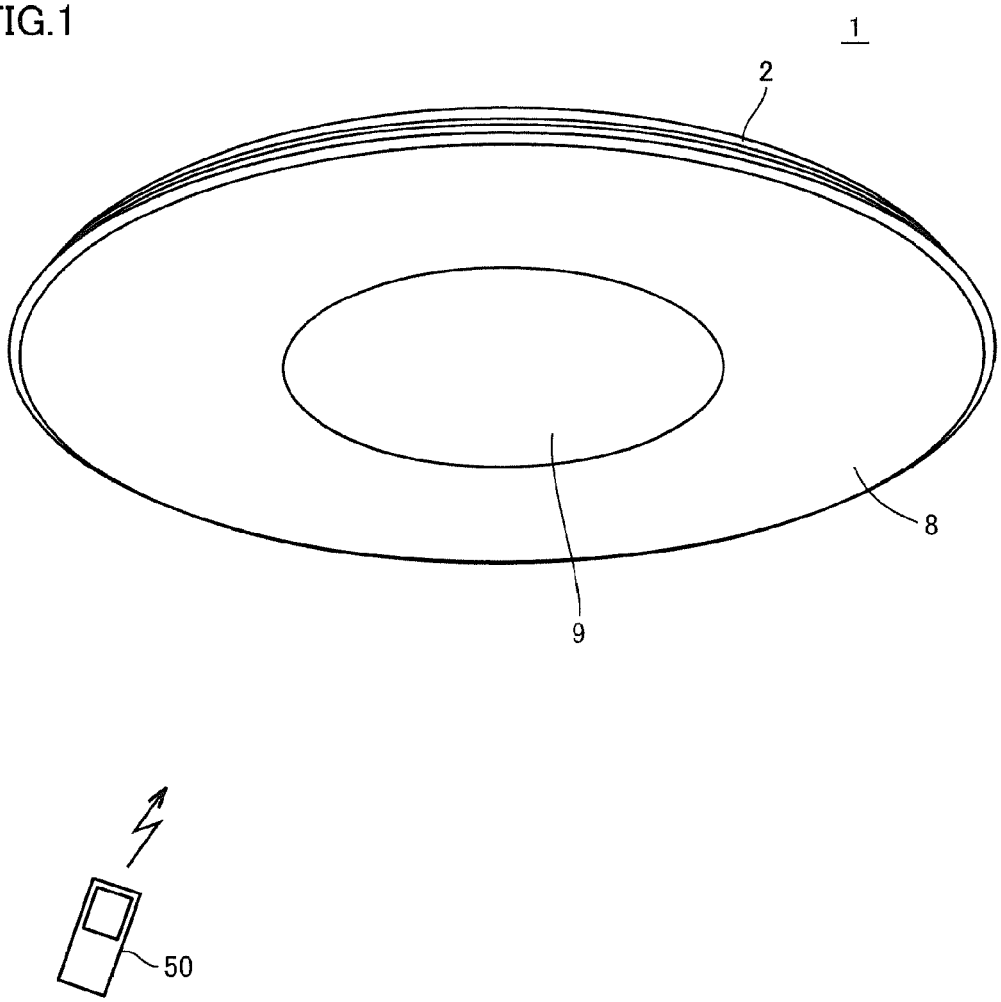
FIG. 1 shows an appearance of a lighting device 1 in accordance with an embodiment of the present invention.

In the following, embodiments of the present invention will be described with reference to the figures. In the following description, the same components are denoted by the same reference characters. Their names and functions are also the same. Therefore, detailed description thereof will not be repeated.

FIG. 1 shows an appearance of lighting device 1 in accordance with an embodiment of the present invention.

Referring to FIG. 1, lighting device 1 in accordance with an embodiment of the present invention is shown having a chassis 2 for fixing a main body part, and covers 8 and 9 for covering the entire surface of main body part together with chassis 2. As an example, here, it is assumed that chassis 2 of lighting device 1 is fixed on a ceiling.

Cover 8 is provided corresponding to an area where LED modules for illumination are arranged. Light is emitted from the area of cover 8.

The other cover 9 provided near the center of cover 8 is provided corresponding to an area where a control device such as a circuit board for controlling the LED modules and the like is arranged. Since no LED module is arranged in the area corresponding to cover 9, light is not emitted therefrom.

The portable remote controller 50 is provided for operating lighting device 1. By operating remote controller 50, various operation instructions can be issued to lighting device 1. Details of remote controller 50 will be described later.

Figure 2:
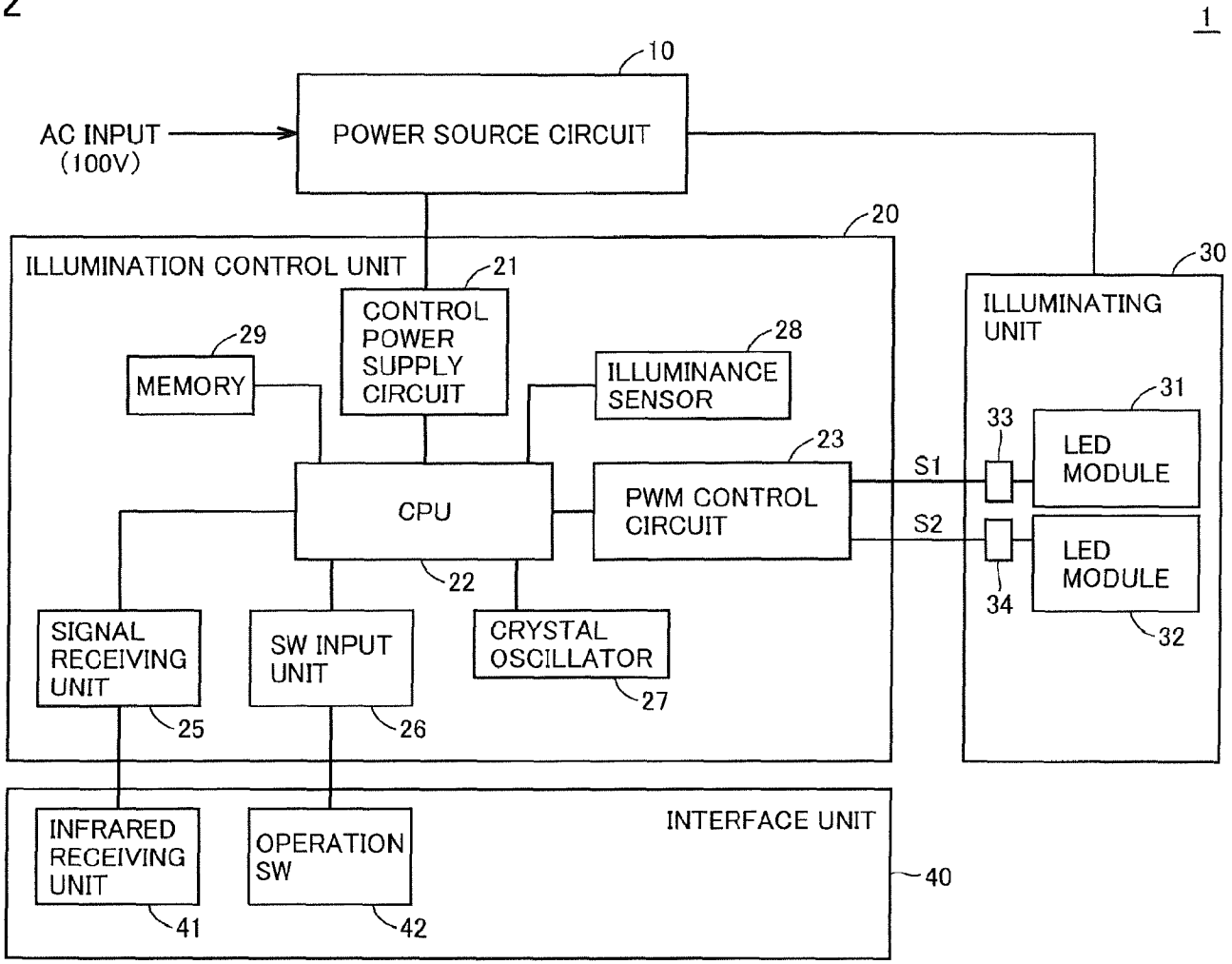
FIG. 2 is a schematic block diagram showing hardware of lighting device 1 in accordance with the embodiment of the present invention.

FIG. 2 is a schematic block diagram showing hardware of lighting device 1 in accordance with an embodiment of the present invention.

Referring to FIG. 2, lighting device 1 in accordance with the present embodiment includes a power source circuit 10, an illumination control unit 20, illuminating unit 30, and an interface unit 40.

Power source circuit 10 receives an AC power input (AC input) (100V), converts it to a DC voltage, and supplies the voltage to various portions of the device. Though the voltage is shown to be supplied only to a control power supply circuit 21 and illuminating unit 30 as an example here, it is not limiting and necessary voltage is supplied to other portions as well.

Illumination control unit 20 includes: control power supply circuit 21 for adjusting the voltage supplied from power source circuit 10 to be supplied to a CPU 22; CPU (Central Processing Unit) 22 for overall control of lighting device 1; PWM (Pulse Width Modulation) control circuit 23; a signal receiving unit 25; an SW input unit 26; a crystal oscillator 27; an illuminance sensor 28; and a memory 29. CPU 22, memory 29 and PWM control circuit 23 are implemented by microcomputers.

CPU 22 is connected to various units and instructs necessary operations to control lighting device 1 as a whole.

PWM control circuit 23 generates PWM pulses necessary for driving LED modules 31 and 32 in accordance with an instruction from CPU 22.

Signal receiving unit 25 is connected to an infrared receiving unit 41 included in interface unit 40, and outputs an instruction in response to an infrared signal received by infrared receiving unit 41 to CPU 22.

SW input unit 26 is connected to operation SW (switch) 42 and outputs an instruction in accordance with the operation of operation SW to CPU 22.

Crystal oscillator 27 generates oscillation signals of a prescribed period and outputs these signals to CPU 22. Receiving the oscillation signals (clock signals) input from crystal oscillator 27, CPU 22 executes various operations in synchronization with the clock signals. It is assumed that CPU 22 can accurately keep time in accordance with the oscillation signals output from crystal oscillator 27.

Illuminance sensor 28 measures illuminance around lighting device 1 and outputs the measurements to CPU 22. CPU 22 is capable of controlling dimming rate based on the measured results from illuminance sensor 28.

Memory 29 stores various programs and initial values for controlling lighting device 1, and it is also used as a working memory of CPU 22.

Illuminating unit 30 includes; LED modules 31 and 32 having color temperatures different from each other; and FET (Field Effect Transistor) switches 33 and 34 used for driving LED modules 31 and 32. In the present example, it is assumed that color temperature of LED module 31 is about 6700K, and that of LED module 32 is about 2700K. In the following, LED module 31 will be also referred to as daylight color LED (or simply, daylight color) and LED module 32 will be also referred to as incandescent lamp color LED (or simply, incandescent lamp color). Here, a set consisting of one LED module 31 and one module 32 is shown as an example, and a plurality of such sets may be provided. Further, FET switches 33 and 34 may be provided in PWM control circuit 23.

Interface unit 40 includes infrared receiving unit 41 and operation SW 42. Infrared receiving unit 41 receives the infrared signals from remote controller 50, executes photoelectric conversion of the infrared signals, and outputs the results to signal receiving unit 25.

Operation SW 42 includes a power switch and the like, and an instruction in response to a switch operation such as a user's operation of a power switch is output through SW input unit 26 to CPU 22. It is assumed that when the power switch in on, necessary power is supplied to lighting device 1 and if the power switch is off, power is not supplied to lighting device 1. Various operations described in the present example are realized when the power switch is on.

Figure 3:
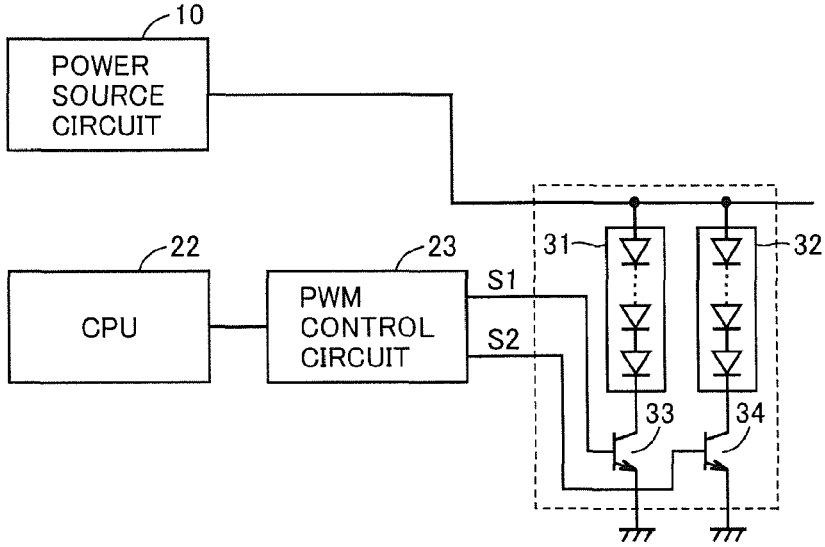
FIG. 3 illustrates a configuration of LED modules 31 and 32 in accordance with the embodiment of the present invention.

FIG. 3 illustrates a configuration of LED modules 31 and 32 in accordance with an embodiment of the present invention.

Referring to FIG. 3, CPU 22 instructs PWM control circuit 23 to generate and output PWM pulses S1 and S2 for driving at least one of LED modules 31 and 32.

LED modules 31 and 32 receive supply of necessary voltage from power source circuit 10. Between LED modules 31 and 32 and a ground voltage GND, FET switches 33 and 34 are provided, respectively.

When FET switches 33 and 34 are rendered conductive/non-conductive in response to PWM pulses S1 and S2, electric current is supplied/stopped to LED modules 31 and 32. When electric current is supplied to LED modules 31 and 32, LED module 31 and 32 emit light, respectively. Though a configuration for driving LED modules 31 and 32 has been described above, the configuration is similar even when a plurality of other LED modules are additionally provided.

Figure 4:
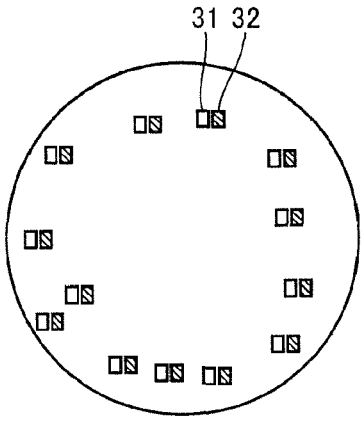
FIG. 4 shows an example of arrangement of LED modules 31 and 32 on lighting device 1.

FIG. 4 shows an example of arrangement of LED modules 31 and 32 on lighting device 1.

Referring to FIG. 4, here, LED modules 31 and 32 are arranged next to each other, and a plurality of such sets are arranged in a circular shape. Since LED modules 31 and 32 having different color temperatures are arranged next to each other, it becomes easier to mix the light emitted from respective LED modules, so that unevenness or variation of color on an illuminated surface can be reduced.

Figure 5:
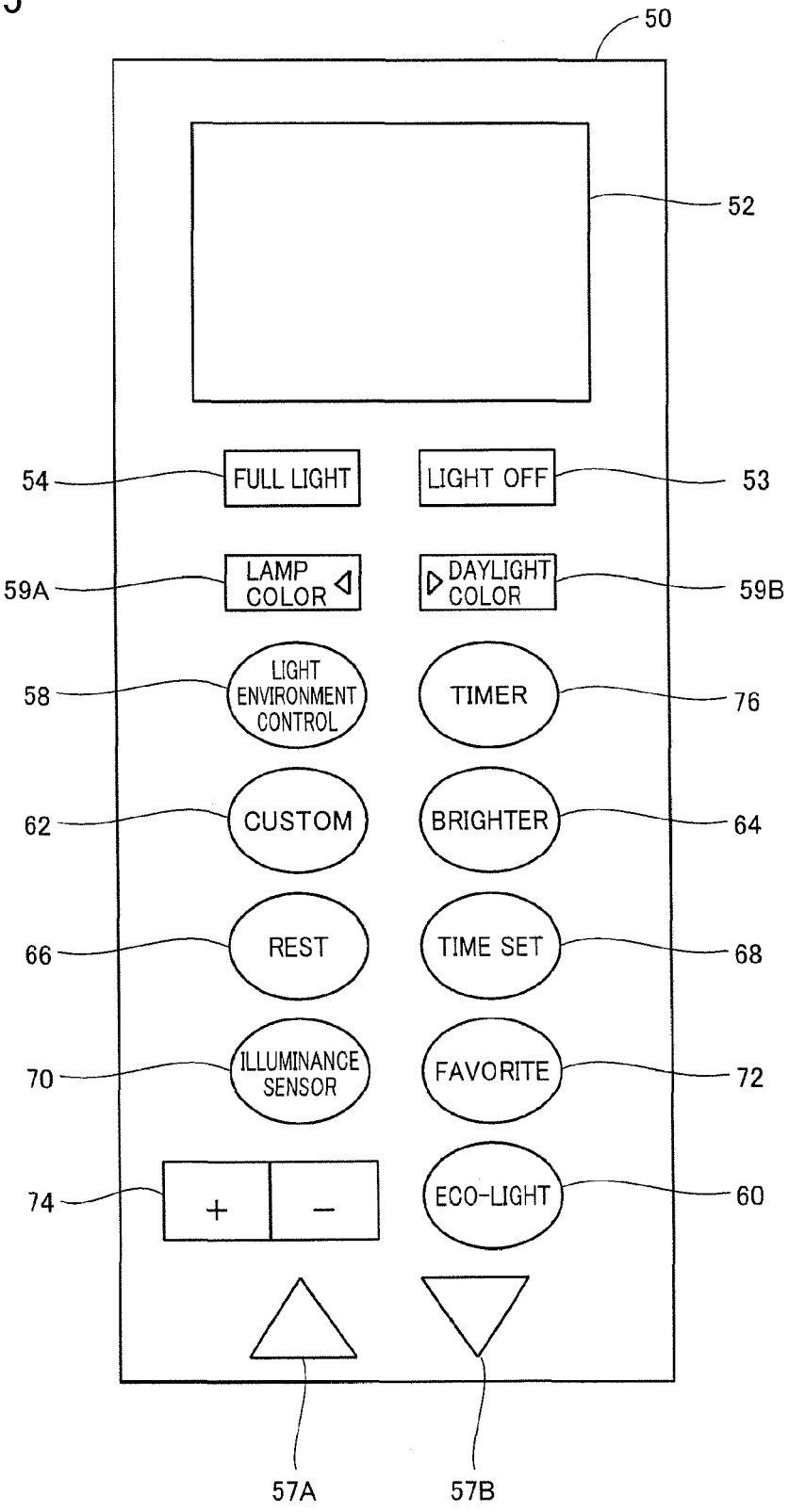
FIG. 5 shows an appearance of a remote controller 50 in accordance with the embodiment of the present invention.

FIG. 5 shows an appearance of remote controller 50 in accordance with an embodiment of the present invention.

Referring to FIG. 5, remote controller 50 is provided with liquid crystal panel 52 and various buttons. A display device other than liquid crystal may be used in place of liquid crystal panel 52.

Here, a plurality of buttons are provided. Specifically, the buttons include: a "FULL LIGHT" button 54; a "LIGHT OFF" button 53; an "UP" button 57A and "DOWN" button 57B for increasing and decreasing dimming rate; a "LAMP COLOR" button 59A and "DAYLIGHT COLOR" button 59B; a "LIGHT ENVIRONMENT CONTROL" button 58; an "ECO-LIGHT" button 60; a "CUSTOM" setting button 62; a "BRIGHTER" button 64; a "REST" button 66; a "TIME SET" button 68; an "ILLUMINANCE SENSOR" button 70; a "FAVORITE" button 72; a "+/−" button 74 for increasing/decreasing numerical values and the like; and a "TIMER" button 76.

When "FULL LIGHT" button 54 is pressed by the user, a full light-on control instruction is output from remote controller 50. CPU 22 of lighting device 1 receives the input of full light-on control instruction from remote controller 50, and instructs PWM control circuit 23 to start full-lighting control of illuminating unit 30. Consequently, in response to pressing of "FULL LIGHT" button 54, that is, an input of full-light-on control instruction from remote controller 50, light is emitted with dimming rate of 100% from illuminating unit 30.

The dimming rate of light emitted from illuminating unit 30 is adjusted stepwise from the state of full-lighting (dimming rate 100%) to dim-lighting (dimming rate 30%), by the operations of "UP" button 57A and "DOWN" button 57B. More specifically, in a state of full-lighting (dimming rate 100%) after pressing of "FULL LIGHT" button 54, if "DOWN" button 57B is pressed, the emission will be half-lighting (dimming rate 50%), and if "DOWN" button 57B is pressed in this state, the emission will be dim-lighting (dimming rate 30%). If "UP" button 57A is pressed in this state, the emission will be half-lighting (dimming rate 50%), and if "UP" button 57A is pressed in this state, the emission will be full-lighting (dimming rate 100%). It is assumed that the current dimming rate is stored in memory 29.

If the user presses "LIGHT-OFF" button 53 while the light is on, a light-off control instruction is output from remote controller 50. CPU 22 of lighting device 1 receives the input of light-off control instruction from remote controller 50, and instructs PWM control circuit 23 to turn off illuminating unit 30. Consequently, in response to pressing of "LIGHT OFF" button 53, that is, an input of light-off control instruction from remote controller 50, emission of light from illuminating unit 30 ends.

Further, if the user presses "LAMP COLOR" button 59A and "DAYLIGHT COLOR" button 59B, an instruction to switch color tone is output from remote controller 50. CPU 22 of lighting device 1 receives the input of color tone switching instruction from remote controller 50, and instructs PWM control circuit 23 to switch lighting of illuminating unit 30. Here, it is assumed that the color tone of light emitted from illuminating unit 30 can be switched in accordance with an input of color tone switching instruction from remote controller 50, that is, in accordance with pressing of "LAMP COLOR" button 59A and "DAYLIGHT COLOR" button 59B. Specifically, when "LAMP COLOR" button 59A is pressed, the color tone is set to be switched stepwise from the daylight color to the incandescent lamp color while dimming rate is maintained. Assume, for example, that in the "daylight color" state of full-light in daylight color (dimming rate 100%), if "LAMP COLOR" button 59A is pressed, the color tone is set to "half daylight color" of daylight color dimming rate of 70% and incandescent lamp color dimming rate of 30%, so that the color tone is changed from the daylight color to the side of incandescent lamp color, with the dimming rate maintained. If "LAMP COLOR" button 59A is pressed again in this state, the color tone is set to "half incandescent lamp color" of daylight color dimming rate of 30% and incandescent lamp color dimming rate of 70%, so that the color tone is further changed from the daylight color to the side of incandescent lamp color, with the dimming rate maintained. Further, when "DAYLIGHT COLOR" button 59B is pressed, the color tone is set to be switched stepwise from the incandescent lamp color to the daylight color while dimming rate is maintained. Assume, for example, that in the "incandescent lamp color" state of full-light in incandescent lamp color (dimming rate 100%), if "DAYLIGHT COLOR" button 59B is pressed, the color tone is set to "half incandescent lamp color" of incandescent lamp color dimming rate of 70% and daylight color dimming rate of 30%, so that the color tone is changed from the incandescent lamp color to the side of daylight lamp color, with the dimming rate maintained. If "DAYLIGHT COLOR" button 59B is pressed again in this state, the color tone is set to "half daylight color" of incandescent lamp color dimming rate of 30% and daylight color dimming rate of 70%, so that the color tone is changed from the incandescent lamp color to the side of daylight lamp color, with the dimming rate maintained. It is assumed that the current color tone is stored in memory 29.

In accordance with these operations, when the user presses "UP" button 57A and "DOWN" button 57B or "LAMP COLOR" button 59A and "DAYLIGHT COLOR" button 59B, the dimming rate or color tone can be changed as preferred by the user, and thus, comfortable light environment can be realized.

Further, if the user presses "LIGHT ENVIRONMENT CONTROL" button 58, a light environment control mode instruction is output from remote controller 50. CPU 22 of lighting device 1 receives the light environment control mode instruction input from remote controller 50, and instructs PWM control circuit 23 to start lighting control in the light environment control mode of illuminating unit 30. The light environment control mode will be described later.

Further, if the user presses "ECO-LIGHT" button 60, an eco-light mode instruction is output from remote controller 50. CPU 22 of lighting device 1 receives the eco-light mode instruction input from remote controller 50, and instructs PWM control circuit 23 to start lighting control in the eco-light mode of illuminating unit 30. The co-light mode will be described later.

Further, if the user presses "CUSTOM" setting button 62, an operation in accordance with custom setting can be started. Custom setting will be described later.

Further, if the user presses "BRIGHTER" button 64, an instruction to increase brightness is output from remote controller 50. CPU 22 of lighting device 1 receives the instruction to increase brightness input from remote controller 50, and instructs PWM control circuit 23 to start lighting control in the brighter mode of illuminating unit 30. The brighter mode will be described later.

Further, if the user presses "REST" button 66, an instruction to set a rest instruction is output from remote controller 50. CPU 22 of lighting device 1 receives the rest instruction input from remote controller 50, and instructs PWM control circuit 23 to start lighting control in the rest mode of illuminating unit 30. The rest mode will be described later.

If the user presses "TIME SET" button 68, it becomes possible to start an operation for time setting. Specifically, when "TIME SET" button 68 is pressed, a time setting screen image (not shown) is displayed on liquid crystal panel 52. On the time setting screen image, the user can set the current time by pressing "+/−" button 74. By pressing "TIME SET" button 68 again, the current time information is output from remote controller 50. CPU 22 of lighting device 1 receives the time information input from remote controller 50, and based on the input time information, it can keep accurate time in accordance with the oscillation signals (clock signals) from crystal oscillator 27. In the light environment control mode in accordance with the present example, lighting control is done in accordance with the time of day and, therefore, if the time is not set in lighting device 1, the light environment control mode is not executed.

If the user presses the "ILLUMINANCE SENSOR" button 70, an operation instruction of the illuminance sensor is output from remote controller 50. CPU 22 of lighting device 1 receives the operation instruction of illuminance sensor 28 input from remote controller 50, and obtains the results of measurement from illuminance sensor 28. Then, CPU 22 controls the dimming rate based on the results of measurement obtained from illuminance sensor 28. By way of example, based on the results of measurement from illuminance sensor 28 that indoor environment such as in a room is sufficiently bright by the incoming sunlight (natural light), for example, it can adjust the illuminance by lowering the set dimming rate. Thus, power consumption can be reduced. On the contrary, if the sunlight (natural light) is blocked and the indoor environment of a room or the like is determined to be dark, it can adjust the illuminance to an appropriate value by increasing the dimming rate again, up to the set dimming rate. If the user presses "ILLUMINANCE SENSOR" button 70 again, an instruction to stop operation of illuminance sensor 28 is output from remote controller 50. CPU 22 of lighting device 1 receives the operation stop instruction of illuminance sensor 28 input from remote controller 50, and stops control of dimming rate based on the results of measurement by illuminance sensor 28. Thus, it becomes possible for the user to set a desired dimming rate, regardless of the results of measurement by illuminance sensor 28.

If the user presses "FAVORITE" button 72, the dimming rate and color tone of lighting device 1 at the time of pressing of this button are stored in memory 29. Thus, every time the user presses "FAVORITE" button 72 thereafter, the dimming rate and color tone as stored in memory 29 can be reproduced by a single touch, to the convenience of the user.

If the user presses "TIMER" button 76, an operation for setting the timer can be started. Specifically, when "TIMER" button 76 is pressed, a timer setting screen image (not shown) is displayed on liquid crystal display panel 52. On the time setting screen image, the user can set a light-off time or light-on time using "+/−" button 74. When the "TIMER" button 76 is pressed again, the timer setting information is output from remote controller 50. CPU 22 of lighting device 1 receives the timer setting information input from remote controller 50, and executes the timer operation in accordance with the input timer setting information. Specifically, if the light-on time is set, the light-on control is executed when the set time is reached. If the light-off time is set, the light-off operation is executed when the set time is reached. The timer operation in this example is not executed if the time is not set in lighting device 1.

Figure 6:
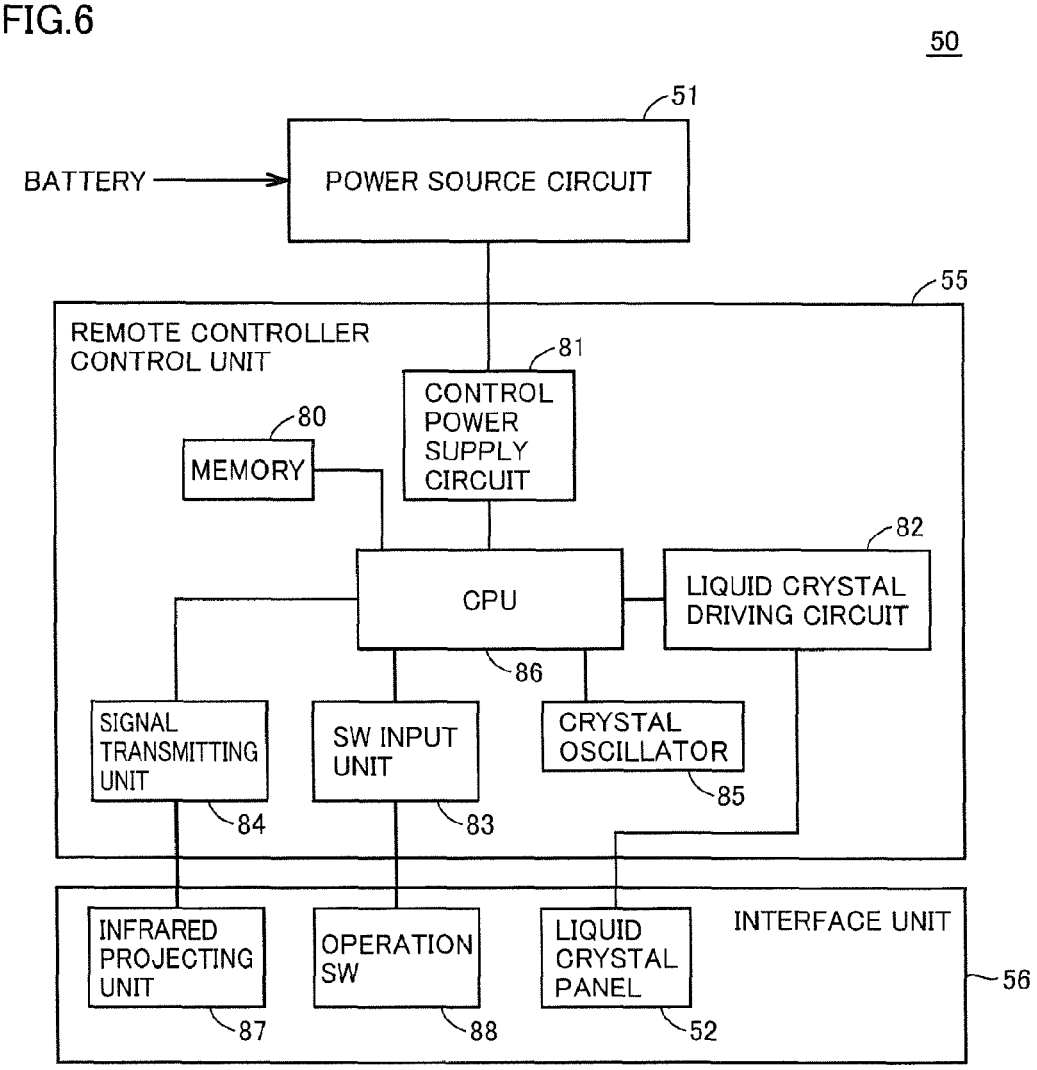
FIG. 6 is a schematic block diagram showing hardware of remote controller 50 in accordance with the embodiment of the present invention.

FIG. 6 is a schematic block diagram showing hardware of remote controller 50 in accordance with an embodiment of the present invention.

Referring to FIG. 6, remote controller 50 in accordance with the present embodiment includes a power source circuit 51, a remote controller control unit 55, and an interface unit 56.

Power source circuit 51 receives electric power supplied from a battery such as a secondary battery, and supplies voltages to various portions and units of the device. Though voltage is shown to be supplied only to control power supply circuit 81 in the present example, it is not limited, and necessary voltage is supplied to other portions as well.

Remote controller control unit 55 includes: control power supply circuit 81 adjusting the voltage from power source circuit 51 to be supplied to CPU 86; CPU (Central Processing Unit) 86 for overall control of remote controller 50; a liquid crystal driving circuit 82 for driving liquid crystal panel 52; a signal transmitting unit 84; a SW input unit 83; a crystal oscillator 85; and a memory 80.

CPU 86 is connected to these units and components, and instructs various operations necessary to control remote controller 50 as a whole.

Liquid crystal driving circuit 82 drives liquid crystal panel 52 displaying a desired screen image in accordance with an instruction from CPU 86.

Signal transmitting unit 84 outputs an instruction from CPU 86 to an infrared projecting unit 87 included in interface unit 56.

SW input unit 83 is connected to operation SW (switch) 88 and outputs an instruction in accordance with the operation of operation SW to CPU 86.

Crystal oscillator 85 generates oscillation signals of a prescribed period and outputs these signals to CPU 86. Receiving the oscillation signals (clock signals) input from crystal oscillator 85, CPU 86 executes various operations in synchronization with the clock signals. It is assumed that CPU 86 can accurately keep time in accordance with the oscillation signals output from crystal oscillator 85.

Crystal oscillator 85 is not absolutely necessary in remote controller 50. If it is not provided, CPU 86 may receive time input made by pressing "TIME SET" button 68 or "+/−" button 74 and may keep current time thereafter, based on the input time.

Memory 80 stores various programs and initial values for controlling remote controller 50, and it is also used as a working memory of CPU 86.

Interface unit 56 includes infrared projecting unit 87, operation SW 88, and liquid crystal panel 52.

Infrared projecting unit 87 converts a signal output from signal transmitting unit 84 to an infrared signal and projects to lighting device 1.

Operation SW 88 consists of the various buttons provided on remote controller 50 as described above. More specifically, it corresponds to the buttons including: "FULL LIGHT" button 54; "LIGHT OFF" button 53; "UP" button 57A and "DOWN" button 57B for increasing and decreasing dimming rate; "LAMP COLOR" button 59A and "DAYLIGHT COLOR" button 59B; "LIGHT ENVIRONMENT CONTROL" button 58; "ECO-LIGHT" button 60; "CUSTOM" setting button 62; "BRIGHTER" button 64; "REST" button 66; "TIME SET" button 68; "ILLUMINANCE SENSOR" button 70; "FAVORITE" button 72; "+/−" button 74 for increasing/decreasing numerical values and the like; and "TIMER" button 76.

CPU 86 of remote controller 50 receives an input instruction of each of the buttons of operation SW 88 through SW input unit 83, and instructs signal transmission unit 84 to output a transmission signal in accordance with each button. In response to the instruction from CPU 86, signal transmission unit 84 outputs a transmission signal in accordance with each button as an infrared signal to lighting device 1 through infrared projecting unit 87. Infrared receiving unit 41 of lighting device 1 receives the infrared signal projected from infrared projecting unit 87 of remote controller 50. Then, infrared receiving unit 41 performs photo-electric conversion of the received infrared signal. Then, signal receiving unit 25 outputs the transmission signal instructed from remote controller 50, obtained by the photo-electric conversion, to CPU 22. As a result of this operation, CPU 22 executes the operation in accordance with the input instruction from remote controller 50.

Specifically, if the user presses "UP" button 57A or "DOWN" button 57B, CPU 22 adjusts the dimming rate of light emission from LED modules 31 and 32 in illuminating unit 30.

By way of example, every time "DOWN" button 57B is pressed from the full-light state (dimming rate 100%), the state of lighting is changed from "FULL LIGHT"→"HALF LIGHT"→"DIM", and every time "UP" button 57A is pressed from this state (dimming rate 30%), the state changes from "DIM"→"HALF LIGHT"→"FULL LIGHT."

Further, as described above, if the user presses "LAMP COLOR" button 59A or "DAYLIGHT COLOR" button 59B, CPU 22 adjusts color tone of light emission of LED modules 31 and 32 in illuminating unit 30. By way of example, every time "LAMP COLOR" button 59A is pressed from the "daylight color" state of full-light in daylight color (dimming rate 100%), the color tone is changed from "daylight color"→"half daylight color"→"half incandescent lamp color"→"incandescent lamp color" and every time "DAYLIGHT COLOR" button 59B is pressed from this state, the color tone changes from "incandescent lamp color"→"half incandescent lamp color"→"half daylight color"→"daylight color."

Though portable remote controller 50 has been described in the example above, it is not limiting, and a remote controller fixed on a wall may be used. Alternatively, the remote controller may be provided as a part of interface unit 40 of lighting device 1. In that case, in place of transmitting the signal of operation SW by infrared signal, the instruction signal from operation SW may be directly transmitted using a signal line. Further, signal transmission is not limited to infrared transmission, and wireless transmission, for example, is also possible.

Next, the light environment control mode in accordance with an embodiment of the preset invention will be described.

<Light Environment Control Mode>

Figure 7:
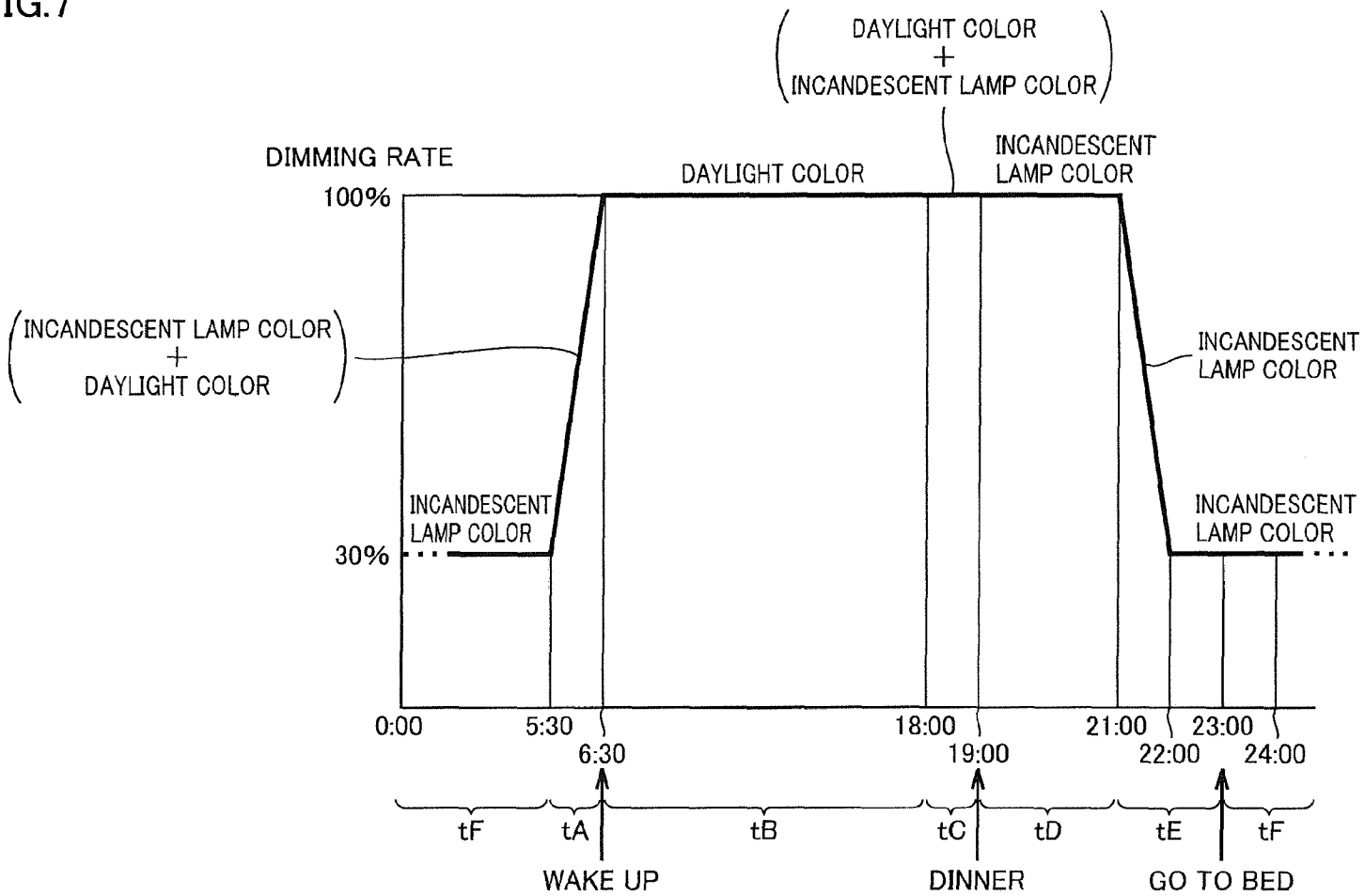
FIG. 7 illustrates dimming rate of a light environment control mode in accordance with the embodiment of the present invention.

FIG. 7 illustrates dimming rate of a light environment control mode in accordance with an embodiment of the present invention.

Referring to FIG. 7, here, an example is shown in which the dimming rate of the daylight color and the incandescent lamp color is adjusted based on correlation with human biological rhythm of 24 hours.

Specifically, 24 hours is divided into 6 time periods of tA to tF, and the dimming rate of daylight color and incandescent lamp color for each time period is set.

Specifically, setting of the time periods are as follows: the time period tA is from 5:30 to 6:30; time period tB is 6:30 to 18:00; time period tC is 18:00 to 19:00; time period tD is 19:00 to 21:00; time period tE is 21:00 to 22:00; and time period tF is 23:00 to 5:30. Here, it is assumed that wake-up time of 6:30, dinner time of 19:00 and bed time of 23:00 are set in advance as default values. As will be described later, the wake up time of 6:30, dinner time of 19:00 and bed time of 23:00 may be changed in custom setting. This will be described later.

FIG. 8 is a table of operations representing operations of illuminating unit 30 in each time period of light environment control mode.

Referring to FIG. 8, an early-morning operation is executed in an hour before wake-up time, that is, in time period tA. Specifically, as the brightness, the dimming rate is changed from night-time dimming rate of 30% to 100%. Further, the color tone is changed from incandescent lamp color to the daylight color. As will be described later, the night time dimming rate can also be changed.

From the wake up time until one hour before the dinner time, that is, in time period tB (6:30 to 18:00), a day-time operation is executed. Specifically, as the brightness, dimming rate of 100% is maintained. Further, as the color tone, daylight color is maintained.

In one hour before the dinner time, that is, time period tC (18:00 to 19:00), a sunset-time operation is executed. Specifically, as the brightness, dimming rate of 100% is maintained. The color tone is changed from the daylight color to the incandescent lamp color.

From the dinner time until two hours before the bed time, that is, in time period tD (19:00 to 21:00), a dinner-time operation is executed. Specifically, as the brightness, dimming rate of 100% is maintained. Further, as the color tone, incandescent lamp color is maintained.

In two hours before the bed time, that is, in time period tE (21:00 to 23:00), bedtime operation is executed. Specifically, as the brightness, dimming rate is changed from 100% to night time dimming rate of 30%. Further, as the color tone, incandescent lamp color is maintained.

From the bed time to one hour before wake-up time, that is, in time period tF (23:00 to 5:30), a night time operation is executed. Specifically, as the brightness, the night time dimming rate of 30% is maintained. Further, as the color tone, incandescent lamp color is maintained.

The operation table described above is only an example, and each time of day and each time period set in the operation table may be changed to different time of day and different time period. Further, a different operation may be introduced.

Again referring to FIG. 7, before wake-up time of period tA, it is possible to gradually adjust the dimming rate to increase brightness and gradually change the color tone from the incandescent lamp color to the daylight color, to facilitate transition from deep to light sleep to fit the wake-up time, and at the wake-up time, to attain the dimming rate of 100% to promote wake-up with refreshed feeling in daylight color close to the color of natural light in day time.

In daytime, that is, time period tB, the daylight color close to the color of natural light is kept, so that comfortable human activity is promoted.

Before the dinner time, that is, in time period tC, the color tone is gradually changed from the daylight color to the incandescent lamp color close to the color of natural color in the evening to attain relaxing effect, and the environment is naturally changed to warm, calming atmosphere.

After dinner, that is, in time period tD, the incandescent lamp color is maintained, so that peaceful, comfortable feeling can be realized in warm, calming atmosphere in the time period of rest.

Before going to bed, that is, in time period tE, the dimming rate is gradually adjusted to be darker, so that human wakefulness is gradually weakened, promoting melatonin secretion that is related to human biological rhythm. This helps people to smoothly fall asleep.

During one's sleep, that is, in time period tF, the dimming rate is kept low to help maintain deep sleep, while the dimming rate allows the user to recognize any object, so that the user may move at night time.

Therefore, by the light environment control mode of lighting device 1 described above, the light environment that automatically adjusts to the color tone and brightness in accordance with human biological rhythm can be realized. Particularly, in the light environment control mode in accordance with the present embodiment, in each period in which the dimming rate or color tone is changed, the change takes place in a natural manner, not causing any feeling of strangeness or discomfort.

By way of example, in time period tA, adjustment is gradually done to change the incandescent lamp color of dimming rate 30% to day light color of dimming rate 100%.

Figure 9:
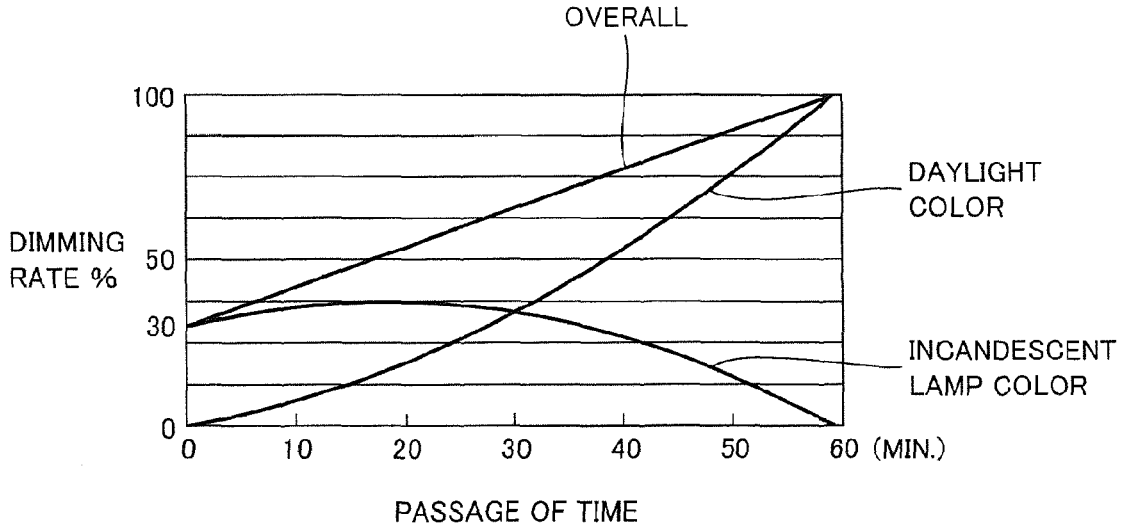
FIG. 9 is a graph of dimming rates of daylight color and incandescent lamp color in a time period tA, in accordance with the embodiment of the present invention.

FIG. 9 is a graph of dimming rates of daylight color and incandescent lamp color in a time period tA, in accordance with an embodiment of the present invention.

Referring to FIG. 9, here, changes in the dimming rate of daylight color, the dimming rate of incandescent lamp color, and the overall dimming rate are shown.

In time period tA, in the initial state, the dimming rate of incandescent lamp color is 30% and the dimming rate of daylight color is 0% and hence, the overall dimming rate is 30%.

Equations for calculating the dimming rates of the graph above will be described.

If the overall dimming rate R is linearly changed from dimming rate A in the initial state to the dimming rate B in a time period T, the dimming rate can be represented by Equation (1) below. Here, the variable t represents time.

$$R = A + \frac{(B-A)}{T}t \tag{1}$$

Next, general equations of dimming rates P and Q of daylight color and of incandescent lamp color are given as Equations (2) and (3).

$$P = R\frac{t}{T} \tag{2}$$

$$Q = R - R\frac{t}{T} \tag{3}$$

By inputting Equation (1) to Equations (2) and (3), respectively, the dimming rates P and Q of daylight color and of incandescent lamp color can be represented by Equations (4) and (5) below.

$$P = \frac{A}{T}t + \frac{(B-A)}{T^2}t^2 \tag{4}$$

-continued $$Q = A + \frac{B-2A}{T}t - \frac{B-A}{T^2}t^2 \quad (5)$$

When time T=60, dimming rate A=30 and dimming rate B=100 are input to Equations (4) and (5), the dimming rates P and Q of daylight color and incandescent lamp color can be represented by Equations (6) and (7).

$$P = \frac{30}{60}t + \frac{70}{60\times 60}t^2 \quad (6)$$

$$Q = 30 + \frac{40}{60}t - \frac{70}{60\times 60}t^2 \quad (7)$$

Based on Equations (6) and (7), the dimming rates P and Q of daylight color and incandescent lamp color can be set.

By way of example, 12 minutes after the initial state, that is, when t=12, the daylight color P and incandescent lamp color R can be calculated in the following manner.

$$P = \frac{30}{60}\times 12 + \frac{70}{60\times 60}\times 12\times 12 = 8.8$$

$$Q = 30 + \frac{40}{60}\times 12 - \frac{70}{60\times 60}\times 12\times 12 = 35.2$$

Based on these equations, it is possible to linearly change the overall dimming rate and to change from the incandescent lamp color to the daylight color in a natural manner. Specifically, when the color tone is changed from the incandescent lamp color to the daylight color, the color is changed to an intermediate color having incandescent lamp color and daylight color mixed, and then eventually to the daylight color. Therefore, the dimming rate can be changed without causing any feeling of strangeness or discomfort, and a comfortable and natural light environment can be realized.

Further in the light environment control mode in accordance with the present embodiment, in time period tC, gradual adjustment from daylight color of 100% dimming rate to incandescent lamp color of 100% dimming rate takes place.

Figure 10:
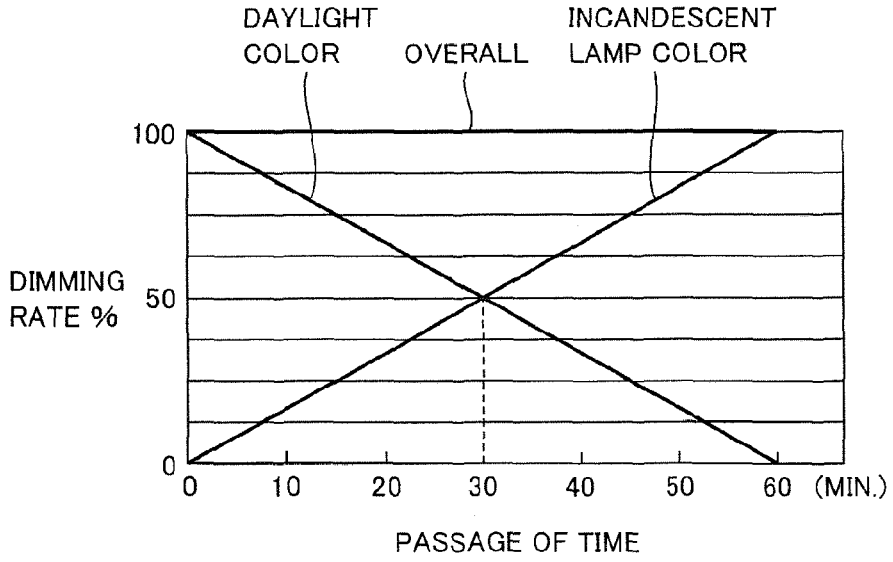
FIG. 10 is a graph of dimming rates of daylight color and incandescent lamp color in a time period tC, in accordance with the embodiment of the present invention.

FIG. 10 is a graph of dimming rates of daylight color and incandescent lamp color in time period tC, in accordance with an embodiment of the present invention.

Referring to FIG. 10, here, changes in the dimming rate of daylight color, the dimming rate of incandescent lamp color and the overall dimming rate are shown.

In time period tC, in the initial state, the dimming rate of incandescent lamp color is 100%, while the dimming rate of daylight color is 0%. Therefore, it shows a setting that the overall dimming rate is 100%.

By the calculation in a similar manner to that of the above-mentioned, the dimming rates of daylight color and incandescent lamp color can be represented by Equations (8) and (9).

$$P = 100 - \frac{100}{60}t \quad (8)$$

$$Q = \frac{100}{60}t \quad (9)$$

It becomes possible to set the dimming rates P and Q of daylight color and of incandescent lamp color based on Equations (8) and (9).

Based on these equations, it is possible to change from the daylight color to the incandescent lamp color in a natural manner, while maintaining the overall dimming rate. Specifically, when the color tone is changed from the daylight lamp color to the incandescent lamp color, the color is changed to an intermediate color having incandescent lamp color and daylight color mixed, and then eventually to the incandescent lamp color. Therefore, the color tone can be changed without causing any feeling of strangeness or discomfort, and a comfortable and natural light environment can be realized.

Further, in the light environment mode in accordance with the present embodiment, in time period tE, the incandescent lamp color of 100% dimming rate is gradually adjusted to incandescent lamp color of 30% dimming rate.

Figure 11:
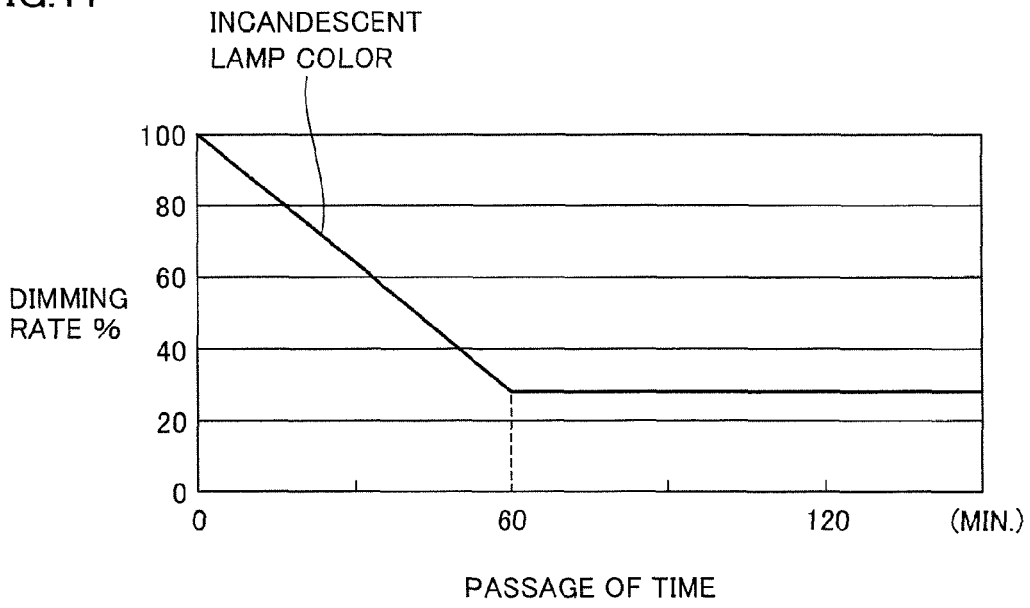
FIG. 11 is a graph of dimming rate of incandescent lamp color in a time period tE, in accordance with the embodiment of the present invention.

FIG. 11 is a graph of dimming rate of incandescent lamp color in time period tE, in accordance with an embodiment of the present invention.

Referring to FIG. 11, in the time period tE, in the initial state, the dimming rate of incandescent lamp color is 100%, and the overall dimming rate is set to 100%.

By the calculation in a similar manner to that of the above-mentioned, the dimming rate of incandescent lamp color can be represented by Equation (10).

$$Q = 100 - \frac{100}{60}t \quad (10)$$

Based on this equation, it is possible to set the dimming rate Q of incandescent lamp color.

By gradually changing the dimming rate Q of incandescent lamp color based on this equation, a comfortable and natural light environment can be realized without causing any feeling of strangeness or discomfort.

The setting of dimming rate of incandescent lamp color is only an example, and it may be adjusted with the rate of change as described in the following.

FIG. 12 is another graph of dimming rate of incandescent lamp color in time period tE, in accordance with an embodiment of the present invention.

Referring to (A) of FIG. 12, here, a graph of double logarithmic scale is shown, in which both ordinate and abscissa represent logs. The unit of ordinate is 0.1%. The unit of abscissa is a minute.

The double-logarithmic graph is set such that the dimming rate and the time have a linear relation. Specifically, the double-logarithmic graph shows an example in which the dimming rate of 100% is adjusted to 30% in a period of 60 minutes.

Referring to (B) of FIG. 12, here, a graph representing the relation of double-logarithmic graph of (A) in a normal manner is shown.

By adjusting the dimming rate Q of incandescent lamp color by such a method, it becomes possible to change the dimming rate without causing any feeling of strangeness or discomfort, and a comfortable and natural light environment can be realized.

Figure 13:
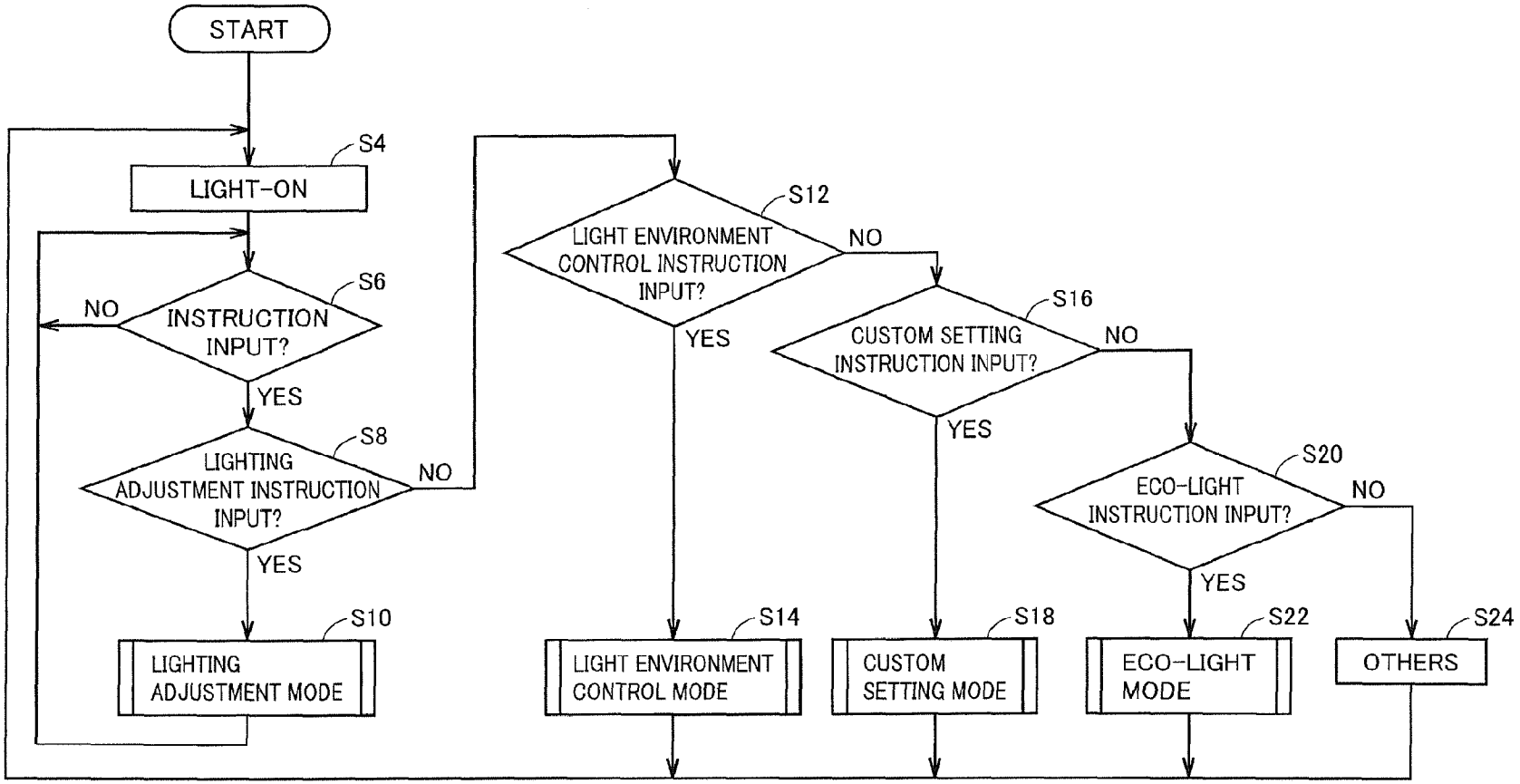
FIG. 13 is a main flowchart of lighting device 1 in accordance with the embodiment of the present invention.

FIG. 13 is a main flowchart of lighting device 1 in accordance with an embodiment of the present invention.

This main flow is started when the power switch is turned on, and it is executed by CPU 22 reading the program stored in memory 29.

When the power switch is turned on and the flow starts, referring to FIG. 13, first, CPU 22 instructs PWM control circuit 23 to execute light-on control of illuminating unit 30 (step S4). Thus, the room is illuminated by the light emitted from illuminating unit 30. At step S4, if the process of any of the operation modes described in the following has been done, CPU 22 instructs light-on control with the dimming rate and color tone set in the corresponding mode. Otherwise, or if the process of any of the operation modes has not been done and it is immediately after power on or after the end of light environment control mode as will be described later, a usual light-on control is instructed. Specifically, an instruction is given to realize a light-on control set in advance for emitting daylight color light with 100% dimming rate, using LED module 31.

Next, CPU 22 determines whether there is an input instruction (step S6). If it is determined at step S6 that there is an input instruction (YES at step S6), CPU 22 determines whether or not a lighting adjustment instruction (step S8) has been input. Specifically, whether or not there is an input instruction of "UP" button 57A or "DOWN" button 57B for adjusting the dimming rate or an input instruction of "LAMP COLOR" button 59A or "DAYLIGHT COLOR" button 59B for adjusting the color tone, provided on remote controller 50, is determined.

If it is determined that a lighting adjustment instruction has been input (YES at step S8), CPU 22 makes a transition to a lighting adjustment mode (step S10). The process in the lighting adjustment mode will be described later.

If it is determined that no lighting adjustment instruction has been input (NO at step S8), next, CPU 22 determines whether or not a light environment control instruction has been input (step S12). Specifically, CPU 22 determines whether or not there is an input of "LIGHT ENVIRONMENT CONTROL" button 58 provided on remote controller 50.

If it is determined that a light environment control instruction has been input (YES at step S12), CPU 22 makes a transition to a light environment control mode (step S14). The process in the light environment control mode will be described later.

On the other hand, if it is determined that no light environment control instruction has been input (NO at step S12), CPU 22 next determines whether a custom setting instruction has been input (step S16).

Specifically, CPU 22 determines whether or not there is an input of "CUSTOM" setting button 62 provided on remote controller 50.

If it is determined that a custom setting instruction has been input (YES at step S16), CPU 22 makes a transition to a custom setting mode (step S18). The process in the custom setting mode will be described later.

On the other hand, if it is determined that no custom setting instruction has been input (NO at step S16), CPU 22 next determines whether or not an eco-light instruction has been input (step S20). Specifically, CPU 22 determines whether or not there is an input of "ECO-LIGHT" button 60 provided on remote controller 50.

If it is determined that an eco-light instruction has been input (YES at step S20), CPU 22 makes a transition to an eco-light mode (step S22). The process in the eco-light mode will be described later.

If it is determined at step S20 that no eco-light instruction has been input (NO at step S20), CPU 22 executes other processes (step S24). Then the flow returns to step S4.

<Lighting Adjustment Mode>

Figure 14:
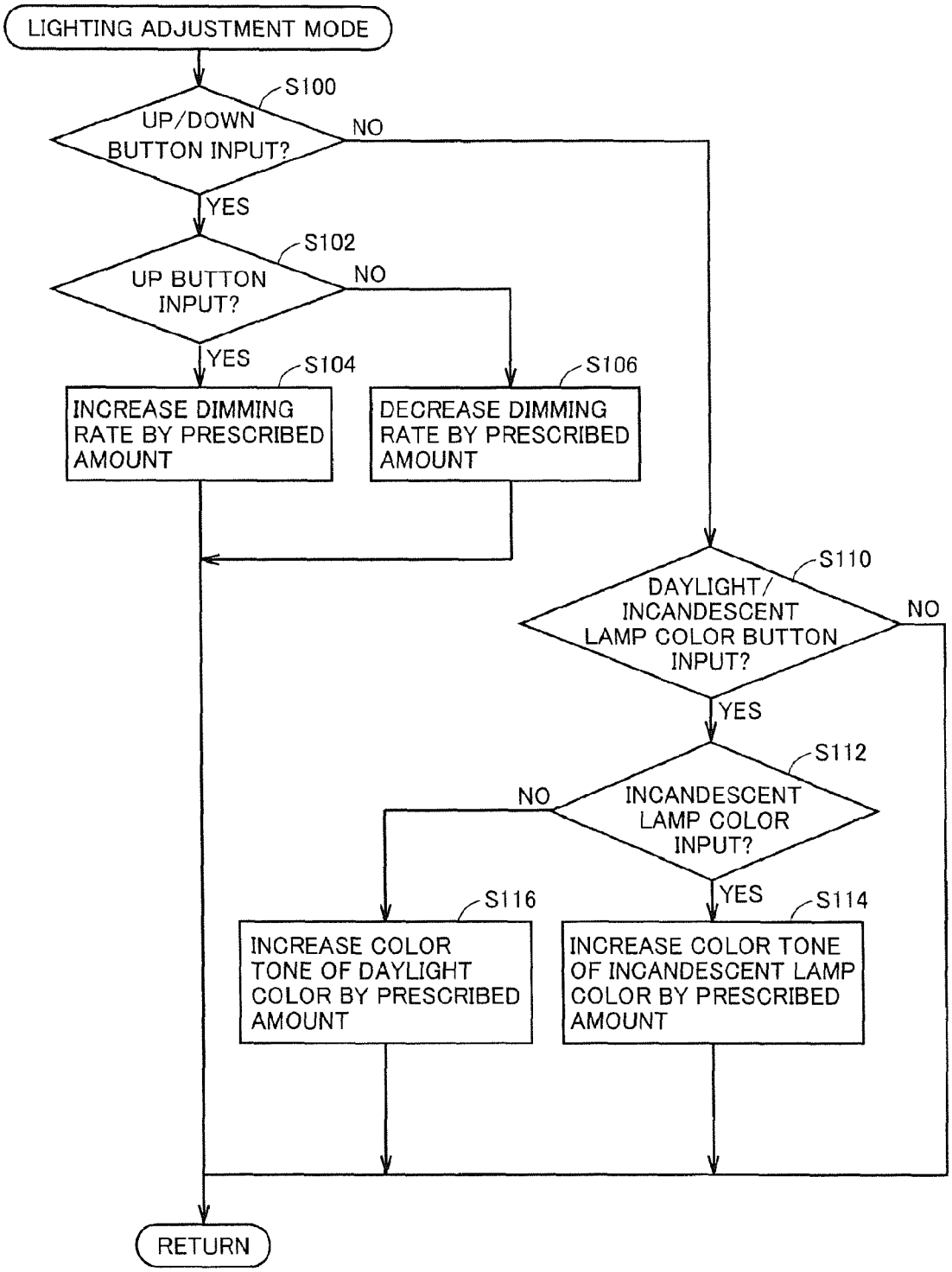
FIG. 14 is a flowchart representing a process in a lighting adjustment mode in accordance with the embodiment of the present invention.

FIG. 14 is a flowchart representing a process in the lighting adjustment mode in accordance with an embodiment of the present invention.

The flow is executed by CPU 22 reading the program stored in memory 29.

Referring to FIG. 14, first, CPU 22 determines whether the instruction corresponds to an input of "UP" button 57A or "DOWN" button 57B (step S100). If it is determined to be neither the input of "UP" button 57A nor "DOWN" button 57B (NO at step S100), the flow proceeds to step S110.

If the instruction is determined to be an input of "UP" button 57A or "DOWN" button 57B (YES at step S100), CPU 22 determines whether the pressed button is "UP" button 57A or "DOWN" button 57B (step S102).

If the pressed button is "UP" button 57A (YES at step S102), CPU 22 increases the current dimming rate by a predefined rate (step S104). If the pressed button is "DOWN" button 57B (NO at step S102), CPU 22 decreases the current dimming rate by a predefined rate (step S106). Then, the process ends (return). Namely, the flow returns to step S6.

Specifically, if the user presses "DOWN" button 57B in a state of full lighting (dimming rate 100%), the light is set to half-lighting state (dimming rate 50%). If the user presses "DOWN" button 57B in the half-lighting state (dimming rate 50%), the light is set to a dim-lighting state (dimming rate 30%). If the user presses "UP" button 57A in the dim-lighting state (dimming rate 30%), the light is set to half-lighting state (dimming rate 50%). If the user presses "UP" button 57A in the half-lighting state (dimming rate 50%), the light is set to the state of full lighting (dimming rate 100%).

If it is determined that the instruction is neither the input of "UP" button 57A nor "DOWN" button 57B (NO at step S100), CPU 22 determines whether the instruction is an input of "LAMP COLOR" button 59A or "DAYLIGHT COLOR" button 59B (step S110).

If it is determined that the instruction is the input of "LAMP COLOR" button 59A or "DAYLIGHT COLOR" button 59B (YES at step S110), CPU 22 next determines whether the pressed button is "LAMP COLOR" button 59A or "DAYLIGHT COLOR" button 59B (step S112). If the pressed button is "LAMP COLOR" button 59A (YES at step S112), CPU increases the dimming rate of the incandescent lamp color side of the current color tone by a predefined rate and decreases the dimming rate of the daylight color side by the predefined rate, while maintaining the dimming rate (step S114). If the pressed button is "DAYLIGHT COLOR" button 59B (NO at step S112), CPU 22 decreases the dimming rate of the incandescent lamp color side of the current color tone by a predefined rate and increases the dimming rate of the daylight color side by the predefined rate, while maintaining the dimming rate (step S116). Then, the process ends (return). Namely, the flow returns to step S6.

Specifically, if the user presses "LAMP COLOR" button 59A in the "daylight color" state of full-light in daylight color (dimming rate 100%), the color tone is set to "half daylight color." If the user presses "LAMP COLOR" button 59A in the "half daylight color" state, the color tone is set to "half incandescent lamp color." If the user presses "LAMP COLOR" button 59A in the "half incandescent lamp color," the color tone is set to "incandescent lamp color." If the user presses "DAYLIGHT COLOR" button 59B in the state of "incandescent lamp color," the color tone is set to "half incandescent lamp color." If the user presses "DAYLIGHT COLOR" button 59B in the "half incandescent lamp color" state, the color tone is set to "half daylight color." If the user presses "DAYLIGHT COLOR" button 59B in the "half daylight color" state, the color tone is set to the "daylight color" state.

<Light Environment Control Mode>

Figure 15:
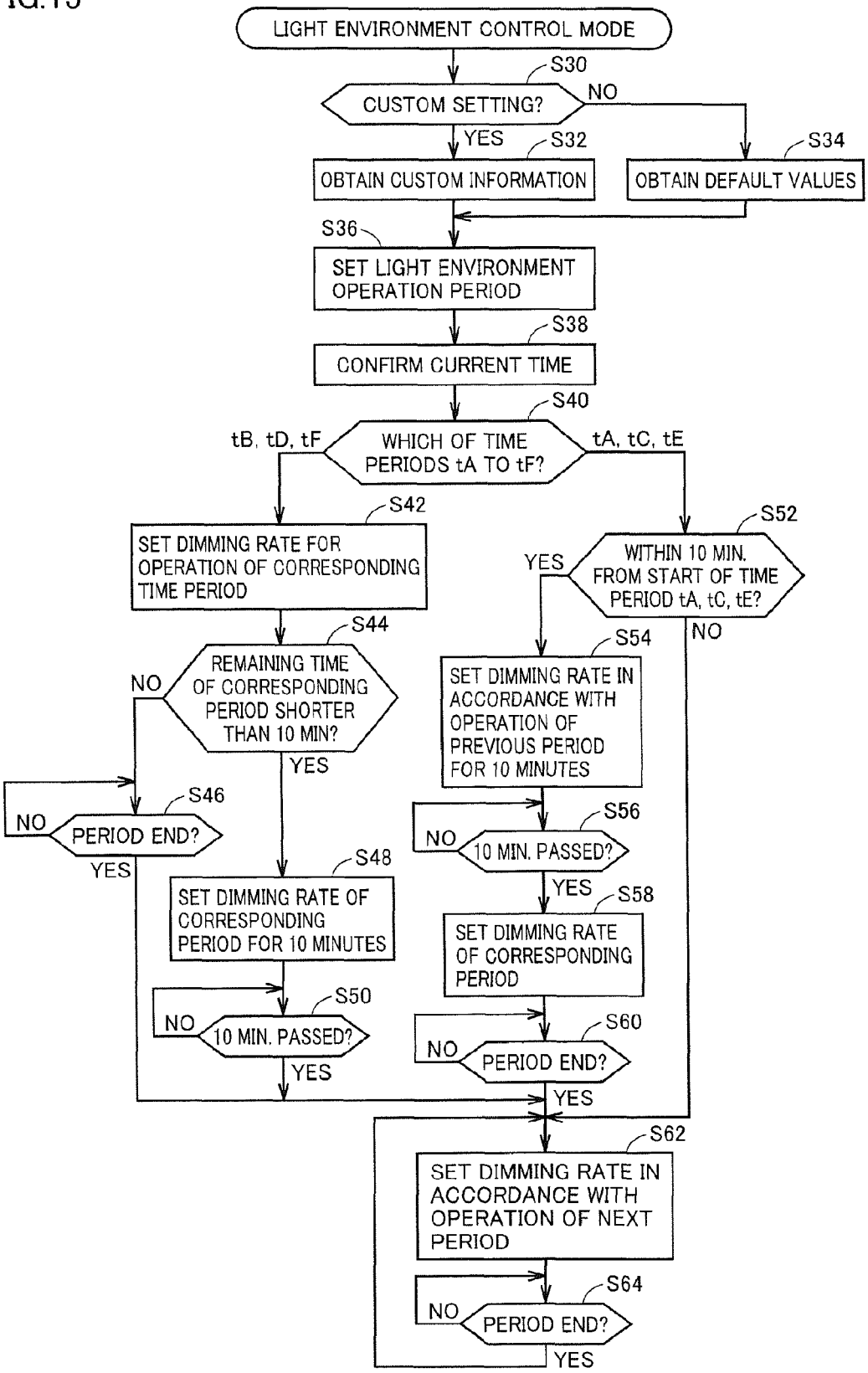
FIG. 15 is a flowchart representing a light environment control mode in accordance with the embodiment of the present invention.

FIG. 15 is a flowchart representing a light environment control mode in accordance with an embodiment of the present invention.

The flow is executed by CPU 22 reading the program stored in memory 29.

Referring to FIG. 15, CPU 22 determines whether or not there is a custom setting (step S30).

If it is determined at step S30 that there is the custom setting, CPU 22 obtains the custom setting information (step S32). The custom setting information will be described later.

If it is determined at step S30 that there is no custom setting, CPU 22 obtains a default value (step S34).

Thereafter, CPU 22 sets a light environment operation period based on the custom setting information or the default value (step S36). Specifically, it sets the time periods tA to tF, in accordance with the wake-up time, dinner time and bed time as described above.

Then, CPU 22 confirms the current time (step S38).

Next, CPU 22 determines to which of time periods tA to tF the current time belongs, based on the current time (step S40).

In accordance with the determination of CPU 22 at step S40 as to which of time periods tA to tF the current time belongs, if it is in the time period of tB, tD or tF, the control proceeds to step S42.

On the other hand, in accordance with the determination of CPU 22 at step S40 as to which of time periods tA to tF the current time belongs, if it is in the time period of tA, tC or tE, the control proceeds to step S52.

If the current time is determined to be in the time period of tB, tD or tF, CPU 22 sets the dimming rate in accordance with the operation of the corresponding time period (step S42).

Then, CPU 22 determines whether or not the remaining time of corresponding time period is shorter than 10 minutes (step S44).

If it is determined at step S44 that the remaining time is shorter than 10 minutes, the dimming rate in accordance with the operation of the corresponding time period is set for 10 minutes (step S48).

Then, whether or not 10 minutes have passed is determined (step S50). After the lapse of 10 minutes, the flow proceeds to the next step.

Specifically, if the current time of starting the light environment control mode is shortly before the end of the operation of corresponding time period of light environment control operation, for example, shorter than 10 minutes, in the present embodiment, the operation of the corresponding time period of light environment control is continued for 10 minutes. By such an approach, abrupt start of the operation of the period following the corresponding period of light environment control operation is avoided, and hence, the user does not feel any strangeness or discomfort. Though the transitional time period of 10 minutes is used here, it is not limiting, and the length may be adjusted in accordance with the user's preference.

If it is determined at step S44 that the remaining time of corresponding period is not shorter than 10 minutes (NO at step S44), CPU 22 determines whether or not the period has expired (step S46).

If it is determined at step S46 that the period has expired, the flow proceeds to the next step.

Again, at step S40, if it is determined that the current time is in the time period of tA, tC or tE, CPU 22 determines whether or not it is within 10 minutes from the start of the time period tA, tC or tE (step S52).

If it is determined at step S52 that it is within 10 minutes (YES at step S52), the dimming rate in accordance with the previous period is set for 10 minutes (step S54).

Then, whether or not 10 minutes have passed is determined (step S56).

If it is determined at step S56 that 10 minutes have passed, the dimming rate in accordance with the operation of the corresponding period is set (step S58).

Then, whether or not the period has expired is determined (step S60). If it is determined that the period has expired, the flow proceeds to the next step S62.

Specifically, if the current time when the light environment control mode is started corresponds to the time period in which the dimming rate and/or color tone is changed among the light environment control operation periods (if it is in the period tA, tC or tE), the operation is executed without causing user's feeling of strangeness or discomfort if it is within 10 minutes from the start of the period.

Specifically, the dimming rate is set in accordance with the operation of the preceding time period for 10 minutes, and after 10 minutes, the operation of the corresponding period of changing the dimming rate and/or color tone is started. By such an approach, abrupt start of the operation of the corresponding period of light environment control operation for changing the dimming rate and/or color tone is avoided, and hence, the user does not feel any strangeness or discomfort. Though the transitional time period of 10 minutes is used here, it is not limiting, and the length may be adjusted in accordance with the user's preference.

On the other hand, if CPU 22 determines at step S52 that it is not within 10 minutes, the control proceeds to the next step.

Specifically, if the current time when the light environment control mode is started corresponds to the time period in which the dimming rate and/or color tone is changed among the light environment control operation periods (if it is in the period tA, tC or tE) and 10 minutes or longer has passed from the start of the period, the dimming rate is set in accordance with the operation of the next period. By such an approach, abrupt start of the operation of the corresponding period for changing the dimming rate and/or color tone is avoided, and hence, the user does not feel any strangeness or discomfort.

Next, at step S62, the dimming rate is set in accordance with the operation the next period (step S62).

Then, whether or not the period has expired is determined (step S64). If it is determined that the period has expired (YES at step S64), the flow returns to step S62, and the dimming rate is set in accordance with the operation of yet another time period.

By repeating such a process, by way of example, the operations of periods tA→tB→tC→tD→tE→tF→tA are repeated, and light adjustment in accordance with the 24-hour life rhythm can be realized.

When the light environment control mode is to be terminated, the user may press the LIGHT ENVIRONMENT CONTROL button on remote controller 50 again. Then, the light environment control mode is stopped by an interruption process, so that the control flow returns to step S4 of FIG. 13 to resume ordinary lighting.

Further, if the user operates the power switch and turns off the power, the light environment control mode ends, as the power supply is stopped. It is assumed that when the user turns on the power switch the next time, the control flow returns to step S4 of FIG. 13 to resume ordinary lighting.

<Custom Setting>

Next, custom setting will be described.

The custom setting refers to a mode for setting the wake-up time, dinner time and bed time of the light environment control mode described above in accordance with individual life rhythm of the user.

When the user presses "CUSTOM" setting button 62 on remote controller 50, the operation enters the custom setting mode.

FIG. 16 specifies settings of wake-up time, dinner time and bed time in accordance with custom setting, in accordance with an embodiment of the present invention.

Referring to FIG. 16, in the example here, it is possible to freely set the wake-up time, dinner time and bed time between 0:00 to 23:59.

As to the wake-up time, setting within one hour and 59 minutes from the bed time is not accepted.

Further, setting of dinner time within 59 minutes from the wake-up time is not accepted. It is assumed that if the setting is unacceptable, the time is automatically set to an initial, preset time.

Next, the flow of custom setting will be described.

If the user presses "CUSTOM" setting button 62 of remote controller 50, a setting screen image is displayed on the side of remote controller 50. Specifically, as CPU 86 reads the program stored in memory 80, the setting screen image as will be described in the following is displayed on liquid crystal panel 52.

FIG. 17 illustrates screen images for custom setting on liquid crystal panel 52 of remote controller 50 in accordance with an embodiment of the present invention.

Referring to (A) of FIG. 17, if "CUSTOM" setting button 62 is pressed, first, a screen image allowing setting of wake-up time is displayed on liquid crystal panel 52. The user can set the wake-up time to an arbitrary value by pressing "+/−" button 74. Here, by way of example, a message "Please set wake-up time" is displayed, and the wake-up time changed from the default setting of "6:30" to "7:00" by the operation of "+/−" button 74 is displayed. Further, a guide message of "If the setting is OK, please press "CUSTOM" setting button" is also displayed. When the user presses the "CUSTOM" setting button, remote controller 50 outputs the wake-up time information displayed on liquid crystal panel 52 (here, 7:00) to lighting device 1. Then, the operation proceeds to setting of the dinner time.

Referring to (B) of FIG. 17, a screen image allowing setting of dinner time is displayed on liquid crystal panel 52. The user can set the dinner time to an arbitrary value by pressing "+/−" button 74. Here, by way of example, a message "Please set dinner time" is displayed, and the dinner time changed from the default setting of "19:00" to "19:30" by the operation of "+/−" button 74 is displayed. Further, a guide message of "If the setting is OK, please press "CUSTOM" setting button" is also displayed. When the user presses the "CUSTOM" setting button, remote controller 50 outputs the dinner time information displayed on liquid crystal panel 52 (here, 19:30) to lighting device 1. Then, the operation proceeds to setting of the bed time.

Referring to (C) of FIG. 17, a screen image allowing setting of bed time is displayed on liquid crystal panel 52. The user can set the bed time to an arbitrary value by pressing "+/−" button 74. Here, by way of example, a message "Please set bed time" is displayed, and the bed time changed from the default setting of "23:00" to "23:30" by the operation of "+/−" button 74 is displayed. Further, a guide message of "If the setting is OK, please press "CUSTOM" setting button" is also displayed. When the user presses the "CUSTOM" setting button, remote controller 50 outputs the bed time information displayed on liquid crystal panel 52 (here, 23:30) to lighting device 1. Then, the operation proceeds to setting of the dimming rate. In the present example, it is possible to set night time dimming rate, in addition to the wake-up time, dinner time and bed time, by the custom setting.

Referring to (D) of FIG. 17, a screen image allowing setting of night time dimming rate is displayed on liquid crystal panel 52. The user can set the night time dimming rate to an arbitrary value by pressing "+/−" button 74. At the time of this setting, CPU 22 of lighting device 1 controls PWM control circuit 23 such that the dimming rate of light emitted from illuminating unit 30 becomes the dimming rate displayed on liquid crystal panel 52. Specifically, first, the dimming rate of lighting device 1 is set to 30%. Then, in accordance with the input of "+/−" button 74 from remote controller 50, an instruction to increase/decrease the dimming rate is output to lighting device 1. In accordance with the instruction to increase/decrease the dimming rate, CPU 22 of lighting device 1 causes PWM control circuit 23 to adjust the dimming rate of light emitted from illuminating unit 30.

Here, by way of example, a message "Please set night time dimming rate" is displayed, and the value "30%" set as the default value of night time dimming rate by the operation of "+/−" button 74 is displayed on liquid crystal panel 52. Further, a guide message of "If the setting is OK, please press "CUSTOM" setting button" is also displayed. When the user presses the "CUSTOM" setting button, remote controller 50 outputs the night time dimming rate information that is eventually displayed on liquid crystal panel 52 (here, 30%) to lighting device 1.

Figure 18:
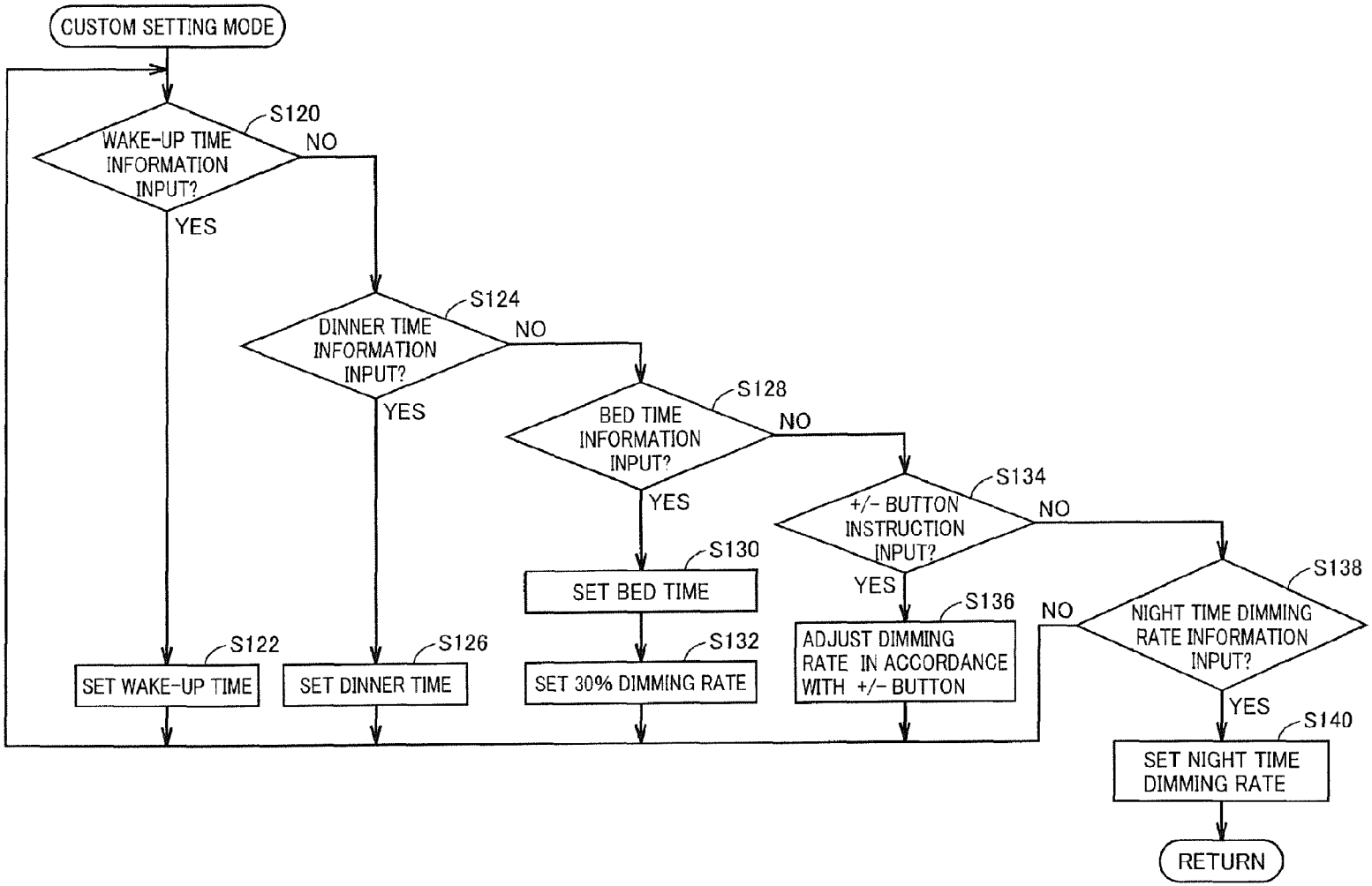
FIG. 18 is a flowchart of custom setting in accordance with the embodiment of the present invention.

FIG. 18 is a flowchart of custom setting in accordance with an embodiment of the present invention.

It is assumed that the flow is executed by CPU 22 reading the program stored in memory 29.

Referring to FIG. 18, when the operation enters the custom setting mode, CPU 22 determines whether or not the wake-up time information has been input (step S120). Specifically, if the wake-up time information from remote controller 50 described with reference to FIG. 17 has been received or not is determined.

If it is determined at step S120 that the wake-up time information has been input (YES at step S120), CPU 22 sets the wake-up time in accordance with the input contents (step S122). Then, the flow returns to step S120.

If it is determined at step S120 that the wake-up time information has not been input (NO at step S120), CPU 22 next determines whether or not the dinner time information has been input (step S124). Specifically, if the dinner time information from remote controller 50 described with reference to FIG. 17 has been received or not is determined.

If it is determined at step S124 that the dinner time information has been input (YES at step S124), CPU 22 sets the dinner time in accordance with the input contents (step S126). Then, the flow returns to step S120.

If it is determined at step S124 that the dinner time information has not been input (NO at step S124), CPU 22 next determines whether or not the bed time information has been input (step S128). Specifically, if the bed time information from remote controller 50 described with reference to FIG. 17 has been received or not is determined.

If it is determined at step S128 that the bed time information has been input (YES at step S128), CPU 22 sets the bed time in accordance with the input contents (step S130).

Thereafter, CPU 22 sets the dimming rate to 30% (step S132). Specifically, CPU 22 controls PWM control circuit 23 such that the dimming rate of emission from LED module 32 attains to 30%. By this operation, the user can recognize the brightness of night time dimming rate of 30%.

Then, the flow returns to step S120.

Next, if it is determined at step S128 that the bed time information has not been input (NO at step S128), CPU 22 determines whether or not an instruction of "+/−" button has been input (step S134).

If it is determined at step S134 that an instruction of "+/−" button has been input (YES at step S134), the dimming rate is adjusted in accordance with the instruction of "+/−" button (step S136).

Then, the flow returns to step S120. By this operation, the user can recognize the brightness of night time dimming rate adjusted in accordance with the instruction of "+/−" button.

If the user operates the "+/−" button as he/she likes, the night time dimming rate can be set to a desired brightness.

If it is determined at step S134 that an instruction of "+/−" button has not been input (NO at step S134), whether the night time dimming rate information has been input is determined (step S138). Specifically, if the night time dimming rate information from remote controller 50 described with reference to FIG. 17 has been received or not is determined.

If it is determined at step S138 that the night time dimming rate information has been input (YES at step S138), the night time dimming rate is set in accordance with the input contents (step S140). Then, the process ends (return).

On the other hand, if it is determined at step S138 that the night time dimming rate information has not been input (NO at step S138), the flow returns to step S120.

By such operations, it becomes possible to set the wake-up time information, dinner time information, bed time information and night time dimming rate information as the custom information in the light environment control mode. The custom information is stored in memory 29. As the custom information is stored in memory 29, the determination at step S30 of FIG. 15 becomes positive. Specifically, it is determined that the custom information is present.

In the light environment control mode, at step S36 of FIG. 15, the light environment control operation time periods are set based on the custom-set wake-up time, dinner time, and the bed time as the custom information stored in memory 29, and the light environment control mode in accordance with the custom setting becomes possible. Further, the night time dimming rate can be set in accordance with the night time dimming rate information.

Therefore, it becomes possible to execute light adjustment and color adjustment in accordance with individual life rhythm and to realize comfortable light environment.

Even when the light environment control mode is being executed as described above, when the user presses "CUSTOM" setting button 62 of remote controller 50, the operation enters the custom setting mode by interruption. When the custom setting mode is terminated, the process of light environment control mode of FIG. 15 is again executed. By such a process, the light environment control mode is executed based on the newly set custom information, and comfortable light environment can be realized.

Though three time points and the night time dimming rate are set in the custom setting mode in the example above, these are not limiting, and it may be possible to allow setting of the time periods and operations shown in FIG. 8 in accordance with the user's preference.

<Eco-Light Mode>

Next, the eco-light mode will be described.

In the eco-light mode, in a prescribed time period from the start of light-on, brightness is reduced by a constant ratio from the brightness at the time of light-on (emission output from illuminating unit 30). Specifically, the light is emitted at the set brightness at the start of lighting. Here, the "start of lighting" includes lighting with the brightness changed by a user operation.

Assume that as the prescribed time period from the start of lighting or from the time of change in dimming rate or color tone, by way of example, 10 minutes is set, and as the constant ratio, 20% of the initial dimming rate X as the brightness at the time point is set. In this case, after 10 minutes from the start of lighting, the brightness is reduced until the dimming rate attains to 80% of the initial dimming rate X.

FIG. 19 is a graph of dimming rate in an eco-light mode in accordance with an embodiment of the present invention.

Referring to (A) of FIG. 19, here, a graph of double logarithmic scale is shown, in which both ordinate and abscissa represent logs. The unit of ordinate is 0.1%. The unit of abscissa is a second.

The double-logarithmic graph is set such that the dimming rate and the time have a linear relation. Specifically, the double-logarithmic graph shows an example in which the dimming rate of 100% is adjusted to 80% in a period of 10 minutes (600 seconds).

Referring to (B) of FIG. 19, here, a graph representing the relation of double-logarithmic graph of (A) in a normal manner is shown.

By dimming through such a method, it becomes possible to reduce the brightness without causing any feeling of strangeness or discomfort, and a comfortable and natural light environment can be realized, while energy can be saved.

Figure 20:
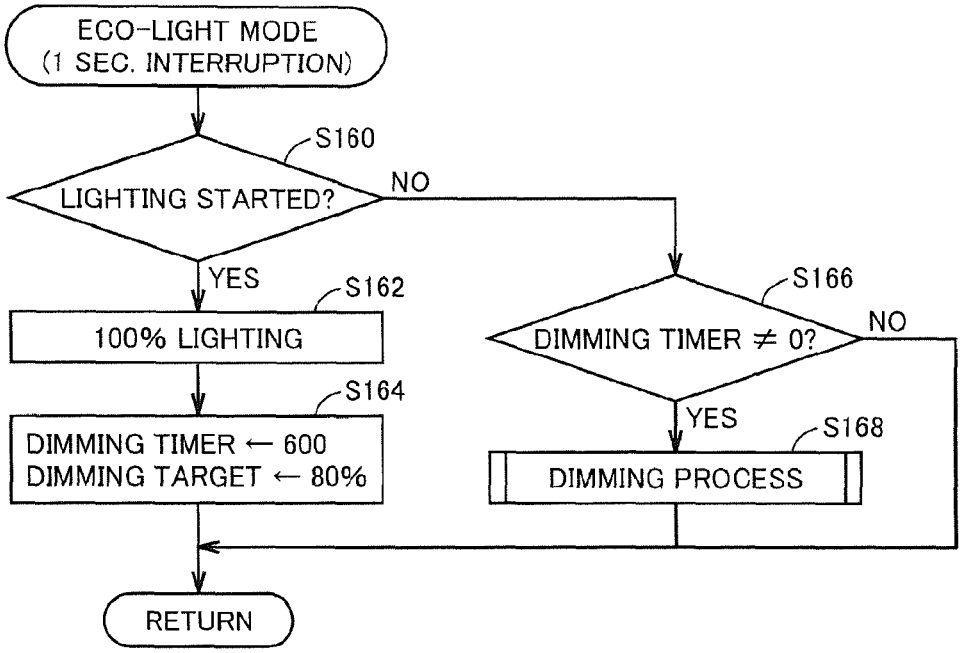
FIG. 20 is a flowchart representing a process in the eco-light mode in accordance with the embodiment of the present invention.

FIG. 20 is a flowchart representing a process in the eco-light mode in accordance with an embodiment of the present invention.

The flow is executed by CPU 22 reading the program stored in memory 29.

CPU 22 executes the process shown in FIG. 20 by an interruption process of a prescribed interval (for example, with the interval of 1 second).

Referring to FIG. 20, first, CPU 22 determines whether or not light emission is to be started (step S160). If it is determined not to be a light-on instruction (NO at step S160), the flow proceeds to step S166.

On the other hand, if it is determined that light emission is to be started (YES at step S160), CPU 22 sets the dimming rate to 100% (step S162). Specifically, CPU 22 controls PWM control circuit 23 such that dimming rate of emission from LED module 31 and/or 32 attains to 100%. By this control, it is possible for the user to recognize the brightness corresponding to the dimming rate of 100%, when the light is turned on.

Next, CPU 22 sets a dimming timer for keeping the time of dimming to a prescribed time period (in this example, 600 seconds), determines the target dimming rate of brightness reduction (in this example, 80%), and ends the process (return). Specifically, the flow returns to step S4.

On the other hand, if it is determined that light emission is to not be started (NO at step S160), CPU determines whether or not the dimming timer is 0 (step S166). If it is determined that dimming timer=0 (NO at step S166), the process ends (return).

If it is determined that dimming timer≠0 (YES at step S166), CPU 22 executes the dimming process (step S168).

Figure 21:
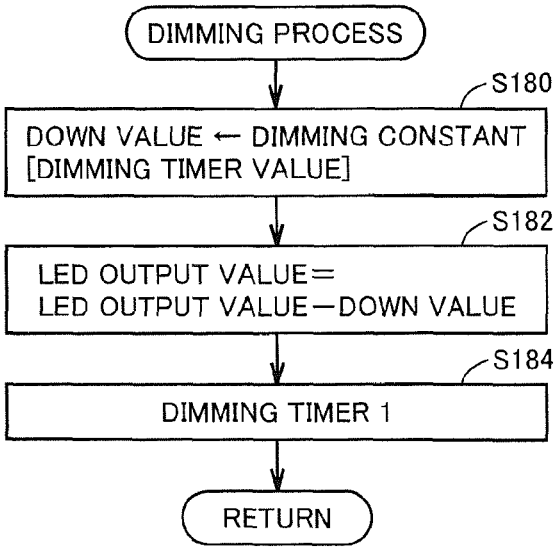
FIG. 21 shows a subroutine of a dimming process of step S168.

FIG. 21 shows a subroutine of a dimming process of step S168.

Referring to FIG. 21, when the dimming process starts, CPU 22 inputs the dimming timer at that time point as a variable in the equation representing the relation between the dimming rate and time shown in FIG. 19, and thereby calculates the value to be reduced (dimming rate) at that time point as a DOWN value (step S180).

Then, CPU 22 sets a value obtained by subtracting the DOWN value from the current output value (dimming rate) as the dimming rate (step S182). Specifically, CPU 22 controls PWM control circuit 23 such that dimming rate of emission from LED module 31 and/or 32 attains to the calculated value.

Thereafter, CPU 22 decrements the dimming timer by 1 (step S184) and ends the dimming process (return).

Though the example above represents an operation from the start of lighting, similar operation is done when the dimming rate or color tone is changed.

By such an operation, in the eco-light mode, the brightness is gradually reduced as shown in FIG. 19 to a brightness of a prescribed ratio of the brightness at the start of lighting or from the brightness at the time of change of the dimming rate or color tone, within a prescribed time period from the start of lighting. The dimming rate is changed linearly with respect to time in the graph of double logarithmic scale in which both ordinate and abscissa represent logs as shown in FIG. 19. The dimming rate may be changed linearly with respect to time. Thus, it becomes possible to change the dimming rate without causing any feeling of strangeness or discomfort, and a comfortable and natural light environment can be realized, while energy can be saved.

In the eco-light mode, when the user presses "ECO-LIGHT" button 60, a light-on control instruction is output from remote controller 50. Receiving the input of light-on control instruction from remote controller 50, CPU 22 of lighting device 1 instructs PWM control circuit 23 to start light-on control of illuminating unit 30. Here, it is assumed that every time the "ECO-LIGHT" button 60 is pressed, that is, every time the light-on control instruction is input from remote control 50, the operation is repeatedly switched to "eco-light mode"→"normal mode"→"eco-light mode" . . . . Specifically, when the light-on control instruction is input from remote controller 50 in the eco-light mode, CPU 22 of lighting device 1 cancels the eco-light mode. Here, CPU 22 controls PWM control circuit 23 such that the brightness at the start of lighting is attained.

It is noted that the eco-light mode can be combined with the light environment control mode. Here, in the light-on control in each of the six time periods tA to tF of the light environment control mode, CPU 22 reduces the brightness to a prescribed ratio of the brightness at the start time, within a prescribed time period from the start of the corresponding period. Further, the light source of the present invention is not limited to an LED, and it may be a fluorescent lamp, EL (Electro-Luminescence) or the like.

<Other Processes>

As other processes, various functions can be executed in accordance with input instructions from remote controller 50.

By way of example, when the user presses "BRIGHTER" button 64, the dimming rate of daylight color can be set to be 100% or higher.

Specifically, if an instruction of "BRIGHTER" button 64 provided on remote controller 50 is input, CPU 22 starts a brighter mode and instructs PWM control circuit 23 such that PWM pulse S1 is adjusted to have dimming rate of LED module 31 equal to or higher than 100%. As will be described later, the current supplied to LED 31 when the dimming rate is set to 100% is set with some margin, so as not to exceed rated current of LED module 31. Therefore, by supplying a current close to the rated current of LED module 31 by reducing the margin, it is possible to set the dimming rate to 100% or higher.

On the other hand, the current close to the rated current imposes excessive load on LED module 31 and, therefore, use of such a function is allowed, for example, for only a prescribed time period (10 minutes). If the prescribed time period is passed, the normal dimming rate of 100% is set.

Though a method of setting the dimming rate of daylight color to 100% or higher has been described here, it is possible to set the dimming rate of incandescent lamp color to 100% or higher.

By using such a function, the dimming rate of daylight color can be set to 100% or higher to attain maximum brightness, to further improve visibility for an intended purpose and hence to realize comfortable light environment.

Further, by way of example, by pressing "REST" button 66 of remote controller 50, it is possible for the user to set the dimming rate of current daylight color or incandescent lamp color to the night-time dimming rate of 30%.

Specifically, if an instruction of "REST" button 66 provided on remote controller 50 is input, CPU 22 starts the rest mode, and instructs PWM control circuit 23 to gradually adjust PWM pulse S1 or S2 such that the dimming rate of LED module 31 or LED module 32 attains to the night-time dimming rate of 30%. By way of example, using the time point when "REST" button 66 is pressed as the start time, the dimming rate is set to attain the night-time dimming rate of 30% after 60 minutes, in a similar manner to that described with reference to FIGS. 11 and 12.

By using such a function, if it is desired, for example, to set the bed time earlier in accordance with the user's preference, the dimming rate can be adjusted to be darker gradually, so that human wakefulness is gradually weakened, promoting melatonin secretion that is related to human biological rhythm. This helps people to smoothly fall asleep.

Further, as described above, by pressing "TIME SET" button 68 on remote controller 50, the user can set the current time of lighting device 1.

Further, as described above, by pressing "ILLUMINANCE SENSOR" button 70 on remote controller 50, the user can adjust the dimming rate based on the result obtained by illuminance sensor 28, to save power consumption.

Further, as described above, by pressing "FAVORITE" button 72 on remote controller 50, the user can conveniently set the stored dimming rate or color tone by a single touch.

Further, as described above, by pressing "TIMER" button 76 on remote controller 50, the user can start the timer setting operation.

The functions of remote controller 50 described above are examples only, and it is naturally possible to arrange buttons for executing other functions and to realize the corresponding functions by CPU 22.

<Light-on/off Control of LED Modules>

Next, the light-on and light-off control of LED modules in accordance with an embodiment of the present invention will be described.

PWM control circuit 23 in accordance with an embodiment of the present invention controls PWM pulses S1 and S2 to be output to LED modules 31 and 32 in accordance with an instruction from CPU 22. More specifically, corresponding to the on period of PWM pulse S1, FET switch 33 is rendered conductive and LED module 31 is turned on. Corresponding to the off period of PWM pulse S1, FET switch 33 is rendered non-conductive and LED module 31 is turned off.

Similarly, in response to the PWM pulse S2 output from PWM control circuit 23, FET switch 34 is rendered conductive/non-conductive and LED module 32 is turned on/off.

CPU 22 is connected to crystal oscillator 27 that outputs oscillation signal of 40 MHz (one period of 25 ns), and in accordance with instructions issued at the timing synchronized with the oscillation signal, PWM control circuit 23 outputs PWM pulses S1 and S2.

Figure 22:
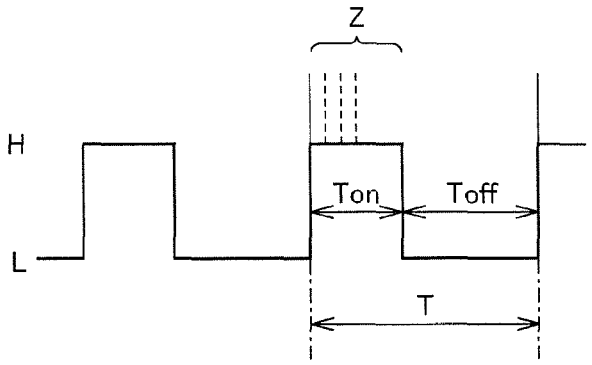
FIG. 22 illustrates generation of a PWM pulse output from a PWM control circuit 23 in accordance with the embodiment of the present invention.

FIG. 22 illustrates generation of a PWM pulse output from PWM control circuit 23 in accordance with an embodiment of the present invention.

Referring to FIG. 22, PWM pulses S1 and S2 output from PWM control circuit 23 are set in accordance with the number of periods (here, Z periods) using one period of 25 nm, which is the minimum unit of the oscillation signal, as the minimum unit. Here, pulses set for the light-on period Ton and light-off period Toff are shown.

The light-on period Ton with the dimming rate of 100% is set with some margin so that the current supplied to LED modules 31, 32 and the like do not exceed the rated current of LED modules 31, 32 and the like.

The cycle time T as the sum of light-on period Ton and light-off period Toff is set to have slightly longer light-on period than when the dimming rate is set to 100%. Therefore, it becomes possible to set the light-on period Ton to be slightly longer than the light-on period when the dimming rate attains to 100% and, hence, by supplying a current close to the rated current to LED modules 31, 32 or the like, the dimming rate of 100% or higher can be attained.

Figure 23:
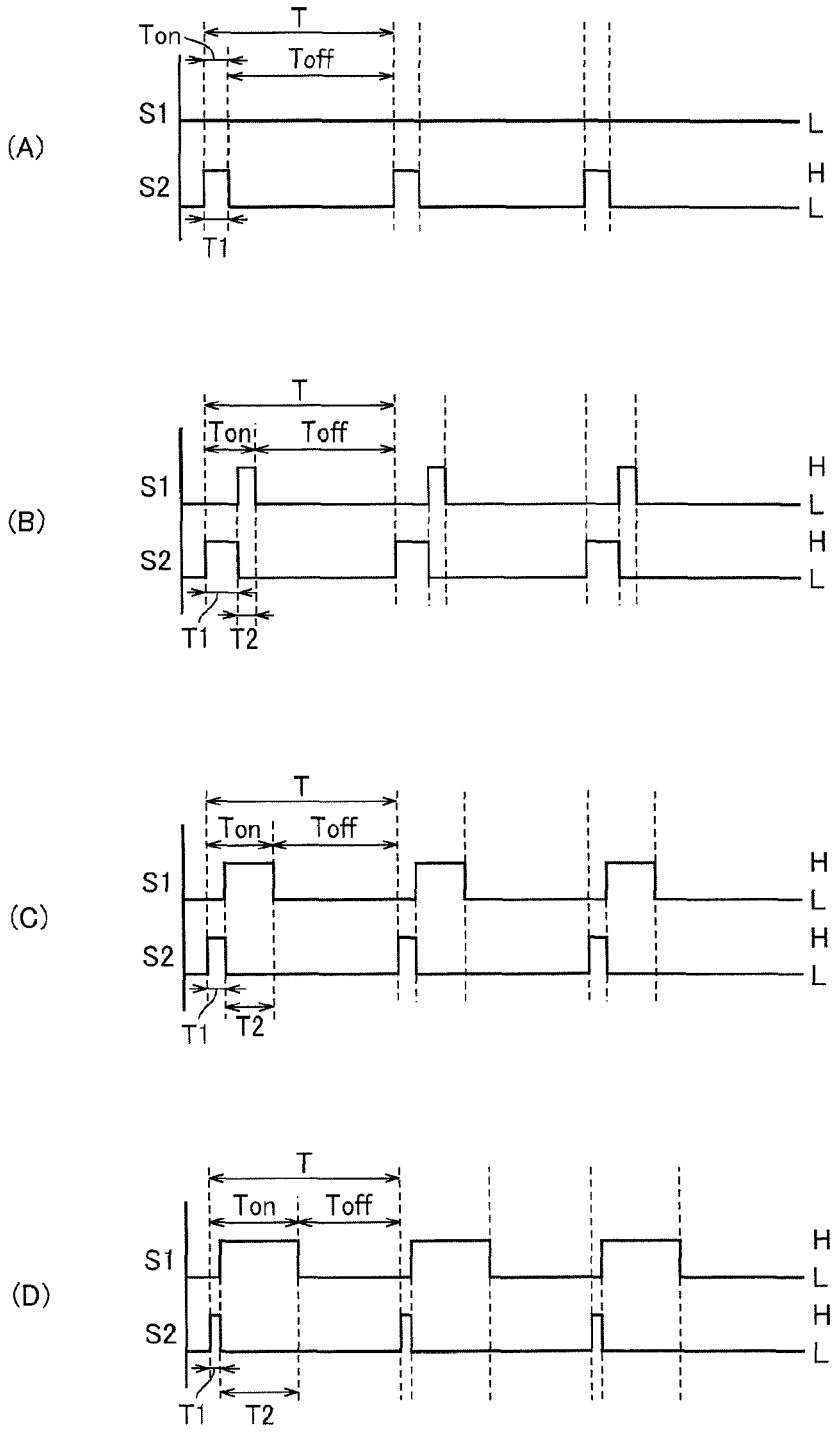
FIG. 23 includes timing charts for adjusting PWM pulses S1 and S2 output from PWM control circuit 23 in accordance with the embodiment of the present invention.

FIG. 23 includes timing charts for adjusting PWM pulses S1 and S2 output from PWM control circuit 23 in accordance with an embodiment of the present invention.

Referring to FIG. 23, PWM control circuit 23 executes periodical light-on/light-off control of LED modules 31 and 32, with the cycle time T set to have a light-on period Ton, in which LED modules 31 and 32 are turned on/off in complementary manner (so that total on-duty of the modules becomes 100%), and a light-off period Toff, in which LED modules 31 and 32 are both turned off. Further, PWM control circuit 23 variably controls the ratio between light-on period T1 of LED module 31 and light-on period T2 of LED module 32 in the light-on period Ton.

In FIG. 23, (A) to (D) represent adjustment of PWM pulses S1 and S2 in the early-morning operation (time period tA) of light environment control.

In FIG. 23, (A) shows an example in which the dimming rate is set to 30% based only on the light-on period of PWM pulse S2, in the initial state. Here, the PWM pulse S1 is always set to the "L" level. In other words, LED module 31 is off.

Then, by adjusting the duty ratio of overall light-on period Ton (light-on periods T1+T2) in the cycle time T as shown in (B) to (D) of FIG. 23, the dimming rate is adjusted linearly.

The dimming rate of each LED with respect to the overall dimming rate is calculated in accordance with Equations (6) and (7), and in accordance with the result of calculation, the light-on periods T1 and T2 of respective LED modules in light-on period Ton are adjusted.

Therefore, by linearly changing the overall dimming rate in accordance with such adjustment of PWM pulses, the dimming rate can be adjusted without causing any feeling of strangeness or discomfort.

<Adjustment of Variations in LED Module Output Characteristics>

In the foregoing, an example has been described in which the overall dimming rate of LED modules 31 and 32 is linearly changed by adjusting duty ratio of the overall light-on period Ton in cycle time T. The overall dimming rate, however, may possibly be different from the actual overall dimming rate, because of variations in output characteristics of LED modules 31 and 32.

Figure 24:
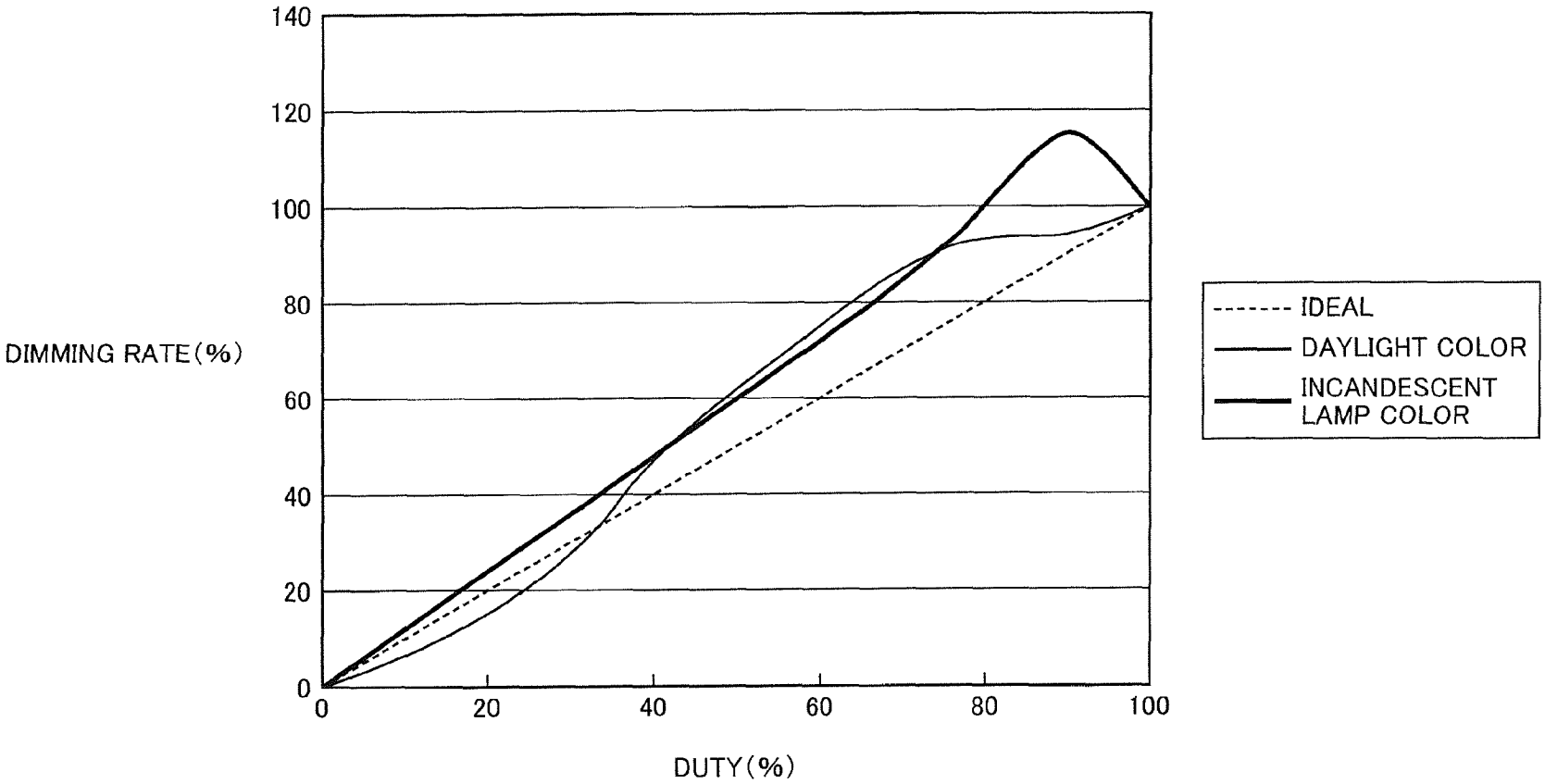
FIG. 24 is a graph showing changes in dimming rate of LED modules 31 and 32 when duty ratio of a light-on period Ton in the cycle time T of PWM pulse is adjusted, in accordance with the embodiment of the present invention.

FIG. 24 is a graph showing changes in dimming rate of LED modules 31 and 32 when duty ratio of a light-on period Ton in the cycle time T of PWM pulse is adjusted, in accordance with an embodiment of the present invention.

Referring to FIG. 24, ideally, if the duty ratio of light-on period Ton in the cycle time T of PWM pulse is linearly changed, the dimming rate desirably changes linearly. Generally, the duty ratio of PWM pulse is calculated in accordance with a linear output characteristic line (ideal), where the duty ratio of PWM pulse set to 100% corresponds to the dimming rate of 100%.

The actual output characteristic lines of dimming rate of LED modules 31 and 32, however, are different from the ideal line of output characteristics, as shown in the figure.

Therefore, when the duty ratio of PWM pulse in accordance with the dimming rate is calculated, if the duty ratio is set based on the ideal line of output characteristics, the set dimming rate may possibly be different from the desired dimming rate.

Figure 25:
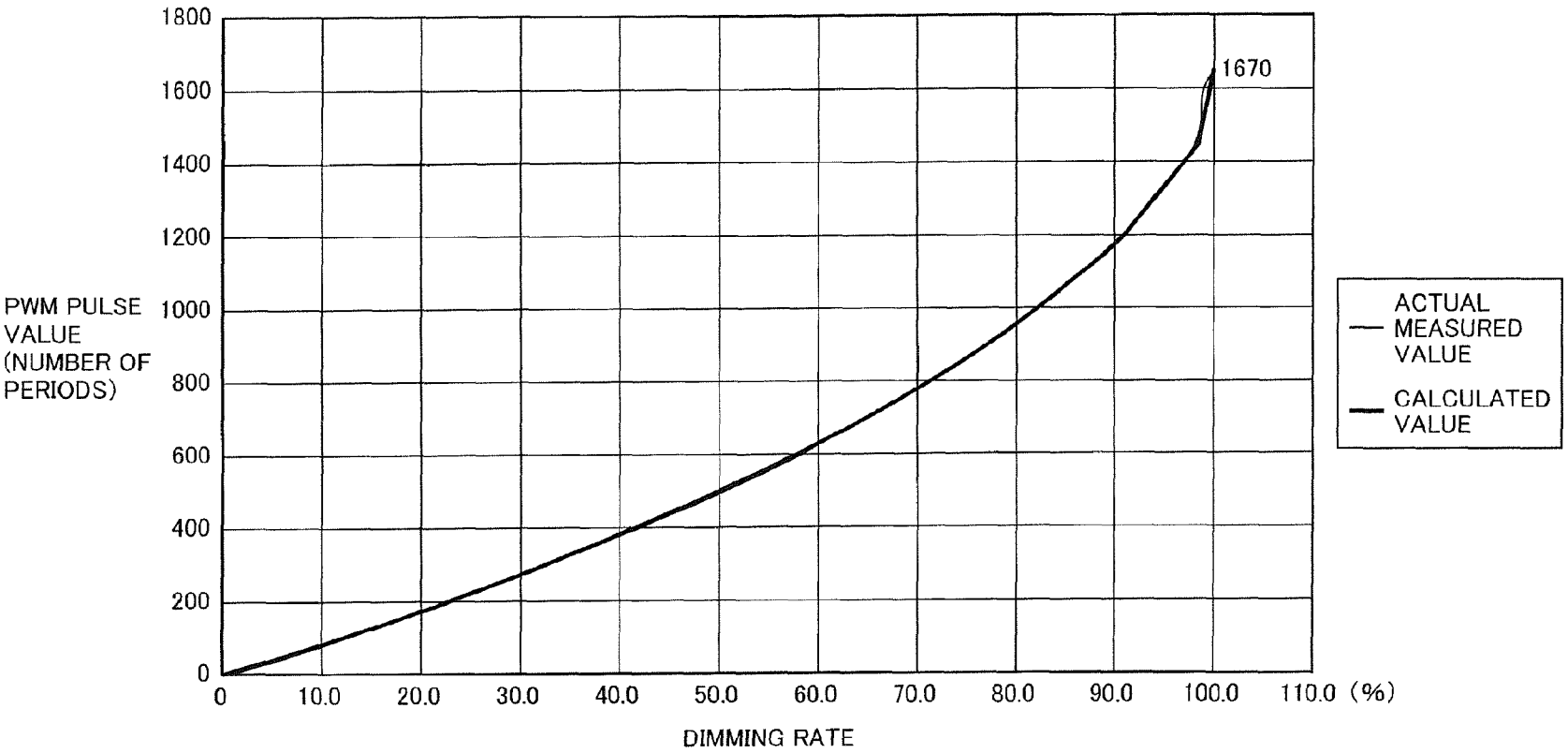
FIG. 25 is a graphs showing a relation between the PWM pulse value and the actually measured dimming rate of LED module 31 (daylight color LED), in accordance with the embodiment of the present invention.

FIG. 25 is a graphs showing a relation between the PWM pulse value and the actually measured dimming rate of LED module 31 (daylight color LED), in accordance with an embodiment of the present invention.

Referring to FIG. 25, here, an output characteristic line is shown, with the ordinate indicating the PWM pulse value (number of periods) and the abscissa indicating the dimming rate (%).

In the present example, it is assumed that the duty ratio of light-on period Ton is set to 100% when the PWM pulse value is 1670.

Figure 26:
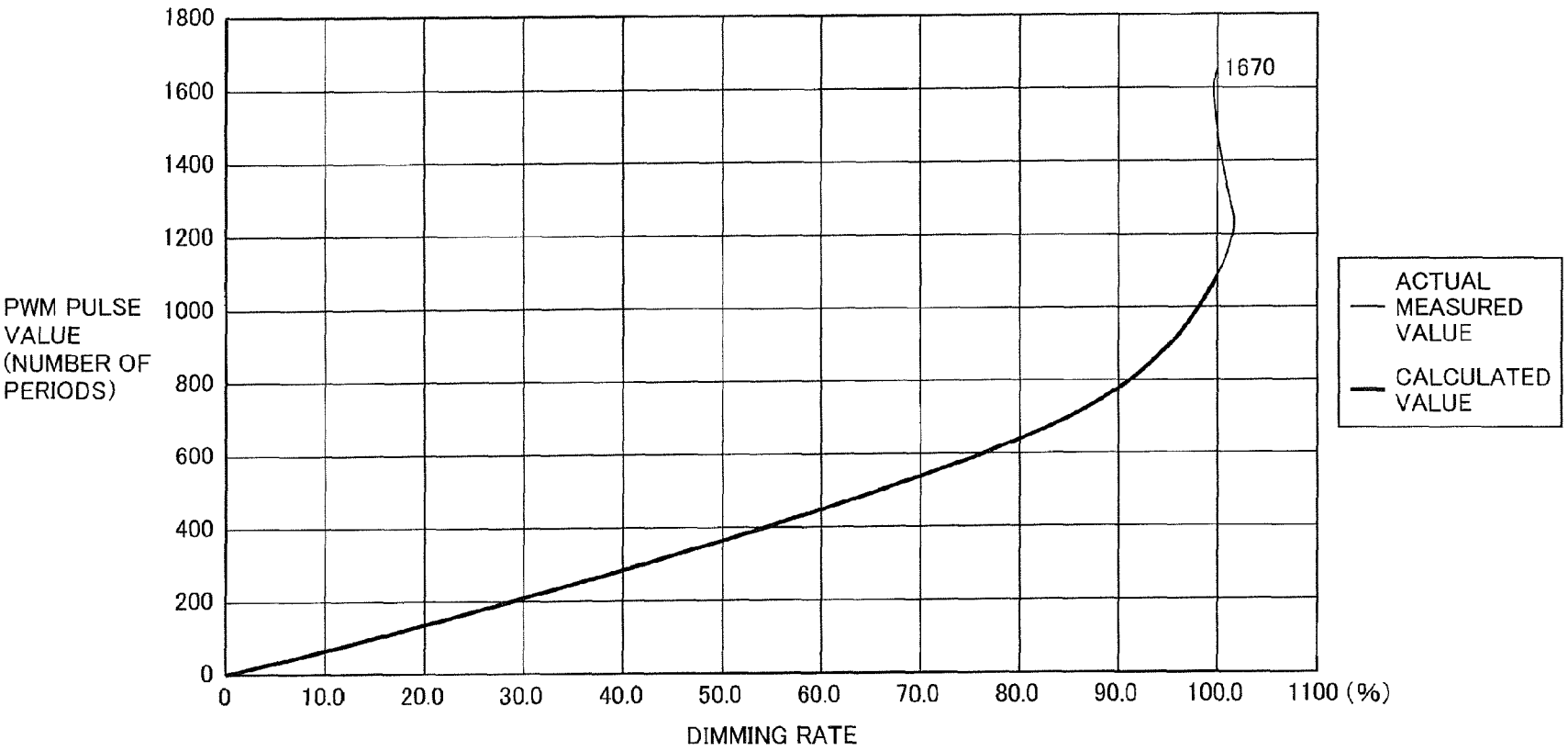
FIG. 26 is a graphs showing a relation between the PWM pulse value and the actually measured dimming rate of LED module 32 (incandescent lamp color LED), in accordance with the embodiment of the present invention.

FIG. 26 is a graph showing a relation between the PWM pulse value and the actually measured dimming rate of LED module 32 (incandescent lamp color LED), in accordance with an embodiment of the present invention.

Referring to FIG. 26, here, an output characteristic line is shown, with the ordinate indicating the PWM pulse value (number of periods) and the abscissa indicating the dimming rate (%).

FIG. 27 specifies approximation formulas of output characteristic lines of LED modules 31 and 32.

FIG. 27 includes approximation formulas for the daylight color LED in accordance with the output characteristic line of LED module 31 shown in FIG. 25 and approximation formulas for the incandescent lamp color LED in accordance with the output characteristic line of LED module 32 shown in FIG. 26.

Here, for the approximation formulas for the daylight color LED, the dimming rate in accordance with the output characteristic line shown in FIG. 25 is divided into four regions, and an approximation formula for each region is calculated. Here, as an example, the dimming rate is divided to "dimming rate 0 to 60%," "dimming rate 60.1% to 91.0%," "dimming rate 91.1% to 98.0%" and "dimming rate 98.1% to 100%." Further, in order to facilitate processing by CPU 22, the approximation formulas are converted to arithmetic expressions. By inputting the desired dimming rate to the variable of the corresponding arithmetic expressions, CPU 22 can calculate the desired PWM pulse value in accordance with the actual output characteristic line of LED module 31.

Similarly, for the approximation formulas for the incandescent lamp color LED, the dimming rate in accordance with the output characteristic line shown in FIG. 26 is divided into four regions, and an approximation formula for each region is calculated. Here, as an example, the dimming rate is divided to "dimming rate 0 to 60%," "dimming rate 60.1% to 91.0%," "dimming rate 91.1% to 98.0%" and "dimming rate 98.1% to 100%." Further, in order to facilitate processing by CPU 22, the approximation formulas are converted to arithmetic expressions. By inputting the desired dimming rate to the variable of the corresponding arithmetic expression, CPU 22 can calculate the desired PWM pulse value in accordance with the actual output characteristic line of LED module 32. In FIGS. 25 and 26, the approximated characteristic lines obtained by the formulas are shown in solid lines.

Specifically, by calculating the PWM pulse value, that is, the duty ratio of PWM pulse corresponding to the dimming rate based on the arithmetic expression, it becomes possible to set the desired dimming rate. Thus, highly accurate light adjustment becomes possible and, more comfortable light environment considering the variations in output characteristics of LED modules can be realized.

As can be seen from the output characteristic line of FIG. 26, the dimming rate attains to 100% before the PWM pulse value is set to 1670, that is, before setting the duty ratio of light-on period Ton to 100%.

Therefore, regarding the approximation formulas of FIG. 27, for the dimming rate up to 99.9%, the approximation formulas are calculated in accordance with the output characteristic line for the dimming rate up to and exceeding 100%, and for the dimming rate of 100.0%, the PWM pulse value is simply set to 1670. Specifically, the approximation formulas are calculated using the output characteristic line only when necessary. Accordingly, in the present example, the PWM pulse value is not set to an unnecessarily high value and hence the duty ratio is kept low, so that power consumption can also be reduced.

Figure 28:
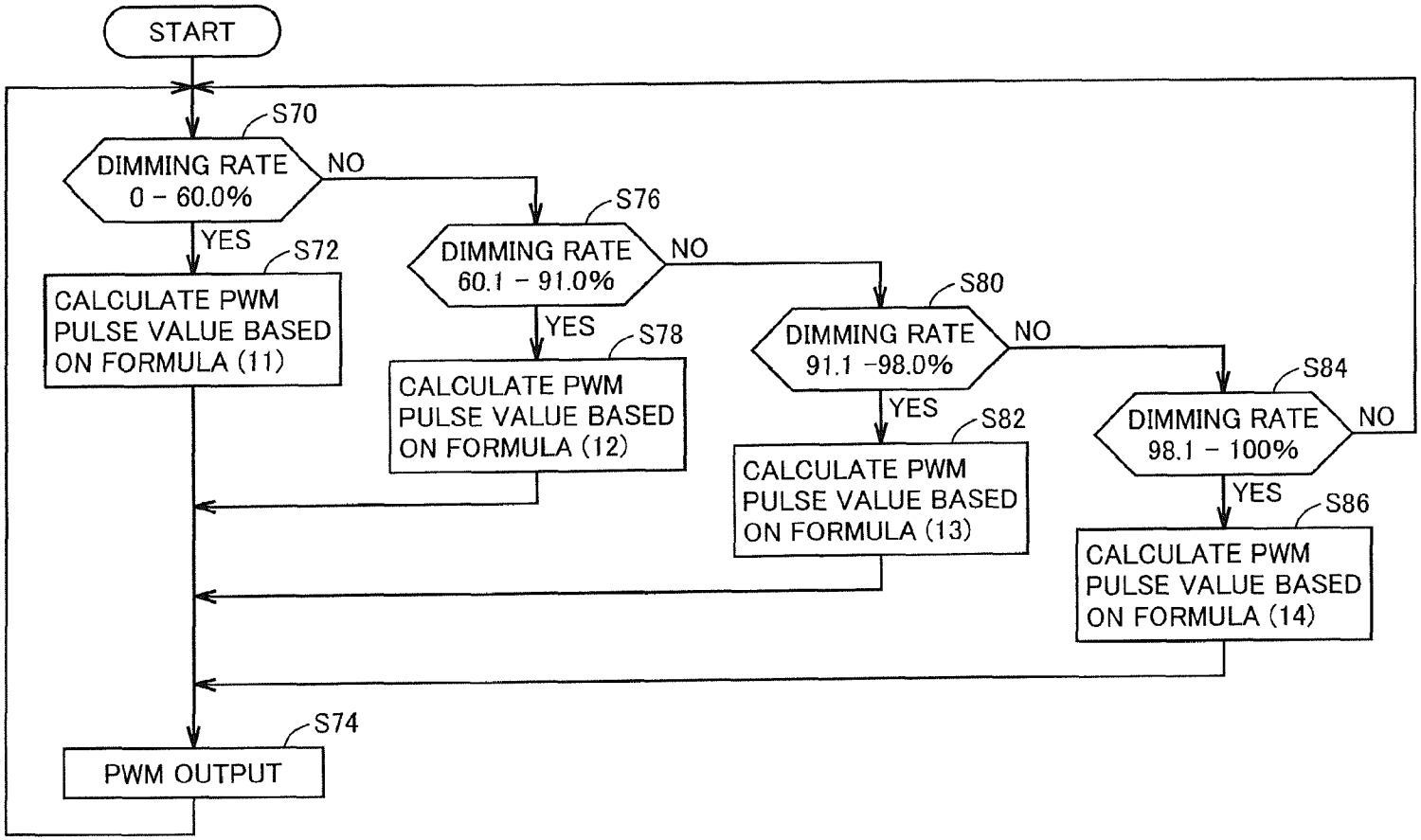
FIG. 28 is a flowchart representing PWM pulse output in consideration of variations of output characteristics of LED module 31 in accordance with the embodiment of the present invention.

FIG. 28 is a flowchart representing PWM pulse output in consideration of variations of output characteristics of LED module 31 in accordance with an embodiment of the present invention.

The flow is executed by CPU 22 reading the program stored in memory 29.

Referring to FIG. 28, CPU 22 determines whether or not the dimming rate is in the range of 0% to 60.0% (step S70).

Then, if it is determined that the dimming rate is in the range of 0% to 60.0% (YES at step S70), CPU 22 calculates the PWM pulse value in accordance with Equation (11) (step S72). Then, based on the calculated PWM pulse value, PWM pulse is output (step S74). Then, the flow returns to step S70.

If it is determined that the dimming rate is not in the range of 0% to 60.0% (NO at step S70), CPU 22 determines whether or not the dimming rate is in the range of 60.1% to 91.0% (step S76). If it is determined at step S76 that the dimming rate is in the range of 60.1% to 91.0% (YES at step S76), CPU 22 calculates the PWM pulse value in accordance with Equation (12) (step S78). Then, based on the calculated PWM pulse value, PWM pulse is output (step S74). Then, the flow returns to step S70.

If it is determined that the dimming rate is not in the range of 60.1% to 91.0% (NO at step S76), CPU 22 determines whether or not the dimming rate is in the range of 91.1% to 98.0% (step S80). If it is determined at step S80 that the dimming rate is in the range of 91.1% to 98.0% (YES at step S80), CPU 22 calculates the PWM pulse value in accordance with Equation (13) (step S82). Then, based on the calculated PWM pulse value, PWM pulse is output (step S74). Then, the flow returns to step S70.

If it is determined that the dimming rate is not in the range of 91.1% to 98.0% (NO at step S80), CPU 22 determines whether or not the dimming rate is in the range of 98.1% to 100.0% (step S84). If it is determined at step S84 that the dimming rate is in the range of 98.1% to 100.0% (YES at step S84), CPU 22 calculates the PWM pulse value in accordance with Equation (14) (step S86). Then, based on the calculated PWM pulse value, PWM pulse is output (step S74). Then, the flow returns to step S70. If it is determined that the dimming rate is not in the range of 98.1% to 100.0% at step S84, CPU 22 returns the control to step S70.

In the present example, the output of PWM pulse S1 considering the variations of output characteristics of LED module 31 has been described. A similar method can be used for the output of PWM pulse S2 considering the variations of output characteristics of LED module 32.

By this process, it becomes possible to calculate the PWM pulse value, that is, the duty ratio of PWM pulse, in accordance with the dimming rate based on the arithmetic expressions. Thus, it is possible to set the desired dimming rate and thereby to realize more comfortable light environment considering variations in output characteristics of LED modules.

Though an example in which the PWM pulse output is calculated considering variations in output characteristics of LED modules by preparing approximation formulas has been described, it is not limiting. By way of example, it is possible to use a correspondence table storing one-to-one correspondence between the PWM pulse value and dimming rate in accordance with the output characteristic line described above.

In the foregoing, it is assumed that lighting device 1 has crystal oscillator 27, and the control in the light environment control mode and the like is realized by CPU 22 accurately keeping time in accordance with the oscillation signals from crystal oscillator 27. Crystal oscillator 27, however, outputs the oscillation signal when a voltage is supplied from power source circuit 10 and, therefore, if the voltage supply should be stopped by a power switch, not shown, included in operation SW 42, time keeping by CPU 22 becomes impossible. In such a situation, when the voltage supply is started next time by the operation of power switch, the time is calibrated to resume time keeping by CPU 22. Here, lighting device 1 may obtain the current time by a command transmission process from remote controller 50. In the following, the command transmission process from remote controller 50 will be described.

Figure 29:
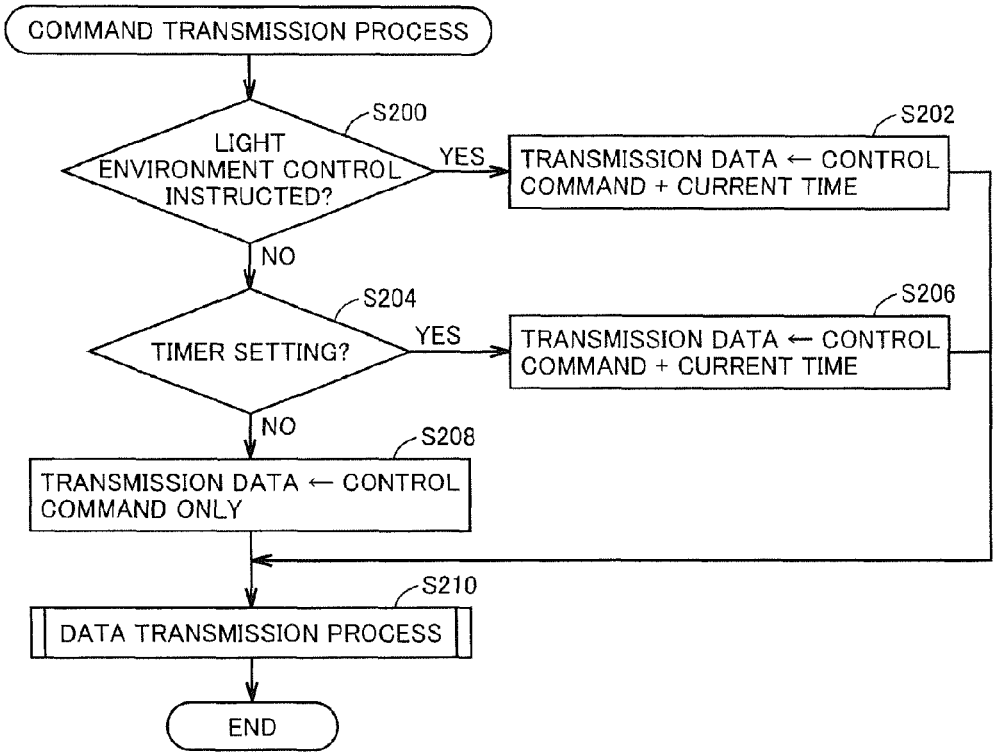
FIG. 29 is a flowchart representing a command transmitting process by remote controller 50 in accordance with the embodiment of the present invention.

FIG. 29 is a flowchart representing a command transmitting process by remote controller 50 in accordance with an embodiment of the present invention.

The flow is executed by CPU 86 reading the program stored in memory 80.

Referring to FIG. 29, when an input of an operation signal indicating that "LIGHT ENVIRONMENT CONTROL" button 58 is pressed (YES at step S200) is received, CPU 86 of remote controller 50 causes signal transmission unit 84 to output a transmission signal (command) to instruct light environment control mode to infrared projecting unit 87. Here, CPU 86 measures time in accordance with the oscillation signal from crystal oscillator 85, and outputs a signal indicating the current time, together with the command, to infrared projecting unit 87 (step S202).

When an input of an operation signal indicating that not the "LIGHT ENVIRONMENT CONTROL" button 58 but "TIMER" button 76 is pressed (NO at step S200 and YES at step S204) is received, signal transmitting unit 84 outputs a transmission signal (command) to instruct timer setting, to infrared projecting unit 87. Here, CPU 86 keeps time in accordance with the oscillation signal from crystal oscillator 85, and outputs a signal indicating the current time, together with the command, to infrared projecting unit 87 (step S206).

If the input operation signal does not correspond to an operation of "LIGHT ENVIRONMENT CONTROL" button 58 or "TIMER" button 76 (NO at step S200 and NO at step S204), signal transmitting unit 84 outputs a transmission signal (command) in accordance with the operation signal to infrared projecting unit 87 (step S208). Here, the signal indicating the current time is not output.

Thereafter, signal transmitting unit 84 transmits a transmission signal in accordance with an instruction from CPU 86 to infrared projecting unit 87, and an infrared signal is output from infrared projecting unit 87 to lighting device 1 (step S210).

In this example, it is assumed that, among the control modes of lighting device 1, the light environment control mode and the control mode in accordance with the timer setting are the control modes in which the state of illumination varies with time. If the state of illumination varies with time in any other control mode, however, the signal indicating the current time may be output together with the control command, when such control mode is selected.

Further, in this example, it is assumed that CPU 86 outputs a signal indicating the current time based on the oscillation signal from crystal oscillator 85. Remote controller 50, however, may not include crystal oscillator 85, and the signal indicating the current time based on the time input by pressing "TIME SET" button 68 or "+/−" button 74 may be output.

By this operation, even if voltage supply is stopped by the operation of power switch of lighting device 1 and time keeping by CPU 22 of lighting device 1 becomes impossible, and if activation of a mode requiring time information is instructed from remote controller 50 in this situation, the requested mode can be activated using the time information from remote controller 50 without necessitating any time adjustment operation of lighting device 1.

Further, in this operation, if activation of a mode that requires time information is instructed, the time information is transmitted, and otherwise, the time information is not transmitted. Therefore, the amount of information transmitted from remote controller 50 can be reduced. Thus, power consumption of remote controller 50 necessary for communication can be reduced.

Further, it is possible to provide a program to execute such a control as described with reference to the flow above, by the function of a computer. Such a program may be recorded on a non-transitory computer readable recording medium such as a flexible disk, CD-ROM (Compact disk-Read Only Memory), an ROM (Read Only Memory), an RAM (Random Access Memory) or a memory card to be attached to a computer, and provided as a program product. Alternatively, the program may be provided recorded on a recording medium such as a hard disk built in a computer. Further, the program may be provided by downloading through a network.

The program may call necessary ones of programming modules provided as a part of an operating system of a computer in a prescribed sequence at prescribed timing, to execute the process. In that case, the modules are not included in the program itself, and the process is executed by the cooperation with the OS. The program not including such modules is also encompassed by the present invention.

The program in accordance with the present invention may be provided incorporated as a part of another program. In that case also, the program itself may not include modules of the said another program, and the process is executed by the cooperation with the said another program. The program incorporated in another program in such a manner is also encompassed by the present invention.

The program product thus provided is executed, installed in a program storage such as a hard disk. Further, the program product includes the program itself and the recording medium on which the program is recorded.

Although the present invention has been described and illustrated in detail, it is clearly understood that the same is by way of illustration and example only and is not to be taken by way of limitation, the scope of the present invention being interpreted by the terms of the appended claims.

REFERENCE SIGNS LIST

1 lighting device; 2 chassis; 8, 9 cover; 10, 51 power source circuit; 20 illumination control unit; 21, 81 control power supply circuit; 22, 86 CPU; 23 PWM control circuit; 25 signal receiving unit; 26, 83 SW input unit; 27, 85 crystal oscillator; 28 illuminance sensor; 29, 80 memory; 30 illuminating unit; 31, 32 LED module; 33, 34 FET switch; 40, 56 interface unit; 41 infrared receiving unit; 42, 88 operation SW; 50 remote controller; 52 liquid crystal panel; 55 remote controller control unit; 82 liquid crystal driving circuit; 84 signal transmitting unit; 87 infrared projecting unit.

The invention claimed is:

1. A lighting device, comprising:

a plurality of light emitting units having different color temperatures;

a control circuit for executing emission output control of each of said plurality of light emitting units;

a time keeping unit for keeping time; and a memory storing control information used for emission output control of said plurality of light emitting units to realize a desired light environment at a prescribed time of day; wherein said control circuit executes emission output control of said plurality of light emitting units, with reference to said memory and based on said control information, gradually from before said prescribed time of day so that the desired light environment is realized at the prescribed time of day.

2. The lighting device according to claim 1, wherein said control information stored in said memory corresponds to dimming rates of said plurality of light emitting units corresponding to prescribed time of day for adjusting human life rhythm.

3. The lighting device according to claim 2, wherein said plurality of light emitting units includes first and second light emitting units having different color temperatures;

based on said control information, said control circuit is configured to:

set in a first time period of a day, a first dimming rate by lighting said first light emitting unit;

in a second time period of the day following said first time period, switch lighting of said first light emitting unit to lighting of said second light emitting unit, and set the dimming rate to be changed from said first dimming rate to a second dimming rate;

in a third time period of the day following said second time period, set said second dimming rate by lighting said second light emitting unit;

in a fourth time period of the day following said third time period, switch lighting of said second light emitting unit to lighting of said first light emitting unit, and maintain said second dimming rate;

in a fifth time period of the day following said fourth time period, set said second dimming rate by lighting said first light emitting unit; and in a sixth time period of the day following said fifth time period, set the dimming rate to be changed from said second dimming rate to said first dimming rate, by lighting said first light emitting unit.

4. The lighting device according to claim 1, further comprising a setting receiving unit for setting said control information.

5. The lighting device according to claim 1, wherein said control circuit gradually increases dimming rate of at least one of said plurality of light emitting units from before said prescribed time of day.

6. The lighting device according to claim 1, wherein said control unit gradually reduces dimming rate of at least one of said plurality of light emitting units and gradually increases dimming rate of another light emitting unit, different from said at least one, of said plurality of light emitting units, as time passes.

7. The lighting device according to claim 6, wherein said control circuit adjusts the dimming rate of said at least one light emitting unit and the dimming rate of said another light emitting unit to be changed in accordance with a linear function.

* * * * *